US007775939B2

(12) United States Patent
Nakanishi

(10) Patent No.: US 7,775,939 B2
(45) Date of Patent: Aug. 17, 2010

(54) BALANCE EXERCISE MACHINE

(75) Inventor: Ryusuke Nakanishi, Nagoya (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 192 days.

(21) Appl. No.: 11/753,166

(22) Filed: May 24, 2007

(65) Prior Publication Data

US 2007/0275358 A1 Nov. 29, 2007

(30) Foreign Application Priority Data

May 26, 2006 (JP) ..... 2006-146596
May 26, 2006 (JP) ..... 2006-146642

(51) Int. Cl.
*A63B 22/00* (2006.01)

(52) U.S. Cl. ..... 482/51; 482/4; 473/97; 434/247

(58) Field of Classification Search ..... 482/51, 482/4; 473/97; 434/247
See application file for complete search history.

(56) References Cited

U.S. PATENT DOCUMENTS 1,443,355 A * 1/1923 French ..... 180/41
2,048,215 A * 7/1936 Miller ..... 104/63
2,092,448 A * 9/1937 Foote ..... 296/24.37
2,657,621 A * 11/1953 Kantz, Jr. et al. ..... 172/257
3,997,979 A * 12/1976 Turner ..... 472/29
4,519,787 A * 5/1985 Williams ..... 446/313
4,957,444 A * 9/1990 Armen ..... 434/247
5,085,425 A * 2/1992 Collins et al. ..... 472/97
5,735,774 A * 4/1998 Maresh ..... 482/57
6,059,666 A * 5/2000 Ohara et al. ..... 472/97
6,120,375 A * 9/2000 Takahashi ..... 463/7
6,210,167 B1 * 4/2001 Nishiyama ..... 434/247
6,402,626 B1 * 6/2002 Beaty ..... 472/96

(Continued)

FOREIGN PATENT DOCUMENTS

JP 2006 61672 3/2006

OTHER PUBLICATIONS

Dictionary.com—http://dictionary.reference.com/browse/Anteroposterior.*

(Continued)

*Primary Examiner*—Steve R Crow
*Assistant Examiner*—Robert F Long
(74) *Attorney, Agent, or Firm*—Greenblum & Bernstein, P.L.C.

(57) ABSTRACT

In a balance exercise machine (1), a swing mechanism (3) that swings a seat (2) in both of an anteroposterior direction (direction X) and a widthwise direction (direction Y) is rotatably supported on a supporting unit (119 around a predetermined rotation axis (T0). A first inclination mechanism (12) that stands up or down the rotation axis (T0) is provided between the supporting unit (11) and a pedestal (4). A second inclination mechanism (20) that can compensate the posture of the seat (2) is provided between the seat (2) and the swing mechanism (3). By driving the swing mechanism (3), the first inclination mechanism (12) and the second inclination mechanism (20) independently with each other, a stroke of swing motion of the seat can be expanded or contracted. Alternatively, by driving the swing mechanism (3), the first inclination mechanism (12) and the second inclination mechanism (20) in conjunction with each other, the trace of the motion of the seat (2) can be varied.

11 Claims, 32 Drawing Sheets

U.S. PATENT DOCUMENTS

| | | | | |
|---|---|---|---|---|
| 6,616,456 | B1 * | 9/2003 | Nalty et al. | 434/247 |
| 6,808,458 | B1 * | 10/2004 | Jung | 472/97 |
| 6,866,594 | B2 * | 3/2005 | Greenwood | 473/422 |
| 6,964,614 | B1 * | 11/2005 | Tsai | 472/58 |
| 7,070,415 | B2 * | 7/2006 | Hojo et al. | 434/247 |
| 7,104,927 | B2 * | 9/2006 | Tsai | 482/51 |
| 7,121,831 | B2 * | 10/2006 | Hojo et al. | 434/247 |
| 7,338,412 | B2 * | 3/2008 | Nakanishi | 482/51 |
| 7,347,806 | B2 * | 3/2008 | Nakano et al. | 482/51 |
| 2002/0115536 | A1 * | 8/2002 | Hojo et al. | 482/51 |
| 2004/0166938 | A1 | 8/2004 | Hojo et al. | |
| 2006/0025226 | A1 * | 2/2006 | Nakano et al. | 472/97 |
| 2006/0073939 | A1 | 4/2006 | Nakanishi | |
| 2006/0073940 | A1 * | 4/2006 | Nakanishi | 482/51 |
| 2006/0147887 | A1 * | 7/2006 | Greenwood | 434/247 |
| 2007/0264903 | A1 * | 11/2007 | Chuang et al. | 446/313 |
| 2008/0009395 | A1 * | 1/2008 | Tseng | 482/51 |
| 2008/0058110 | A1 * | 3/2008 | Chen | 472/97 |
| 2008/0171606 | A1 * | 7/2008 | Chuang et al. | 472/97 |
| 2008/0200271 | A1 * | 8/2008 | Chuang et al. | 472/97 |
| 2008/0227068 | A1 * | 9/2008 | Greenwood | 434/247 |

OTHER PUBLICATIONS

English language Abstract of JP 2006-61672.

U.S. Appl. No. 11/764,971 to Nakanishi, which was filed Jun. 19, 2007.

U.S. Appl. No. 11/763,066 to Nakanishi, which was filed Jun. 14, 2007.

* cited by examiner

BALANCE EXERCISE MACHINE

BACKGROUND OF THE INVENTION

1. Field of the Invention

The present invention relates to a balance exercise machine which is used to exercise a capability of balance of a trainee and to apply a burden due to exercise to the trainee by swinging a seat on which the trainee sits like a horse riding.

2. Description of the Related Art

Recently, the balance exercise machines become popular because they are spread to general households further to medical facilities for rehabilitation exercise as a convenient exercise machine usable from children to seniors. For example, Japanese Laid-Open Patent Publication No. 2006-61672 discloses a conventional balance exercise machine having a compact configuration in which a swing mechanism of a seat is disposed below the seat.

The conventional balance exercise machine having the compact configuration, however, has disadvantages that patterns of motion is not enough and a stroke of the motion of the seat is a little shorter. Thus, if the trainee has habituated to the exercise, he or she may feel dissatisfaction. Furthermore, in a purpose to reinforce a specific region of a human body by selectively performing the exercise, the balance exercise machine is desired to be more efficiency.

SUMMARY OF THE INVENTION

A purpose of the present invention is to provide an improved balance exercise machine which enables to increase patterns of motion and to widen a stroke of the motion of the seat with a compact configuration.

A balance exercise machine in accordance with an aspect of the present invention comprises: a seat on which a trainee sits; a swing mechanism that swings the seat; an extendable and contractible mechanism that varies a distance between the seat and the swing mechanism by extension or contraction thereof so as to vary a stroke of a swing motion of the seat; and a controller that controls the swing mechanism and the extendable and contractible mechanism.

According to such a configuration, when the extendable and contractible mechanism is driven, a distance between the swing mechanism and the seat can be expanded or contracted. For example, when the extendable and contractible mechanism is extended, the stroke of the swing motion of the seat can be expanded, so that the balance exercise machine which enables to increase the patterns of the motion and to widen the stroke of the motion of the seat can be realized. Furthermore, when the extendable and contractible mechanism is driven in conjunction with the swing mechanism, the patterns of the motion of the seat can be increased much more.

While the novel features of the present invention are set forth in the appended claims, the present invention will be better understood from the following detailed description taken in conjunction with the drawings.

BRIEF DESCRIPTION OF THE DRAWINGS

The present invention will be described hereinafter with reference to the annexed drawings. It is to be noted that all the drawings are shown for the purpose of illustrating the technical concept of the present invention or embodiments thereof, wherein.

DETAILED DESCRIPTION OF THE EMBODIMENT

Figure 1:
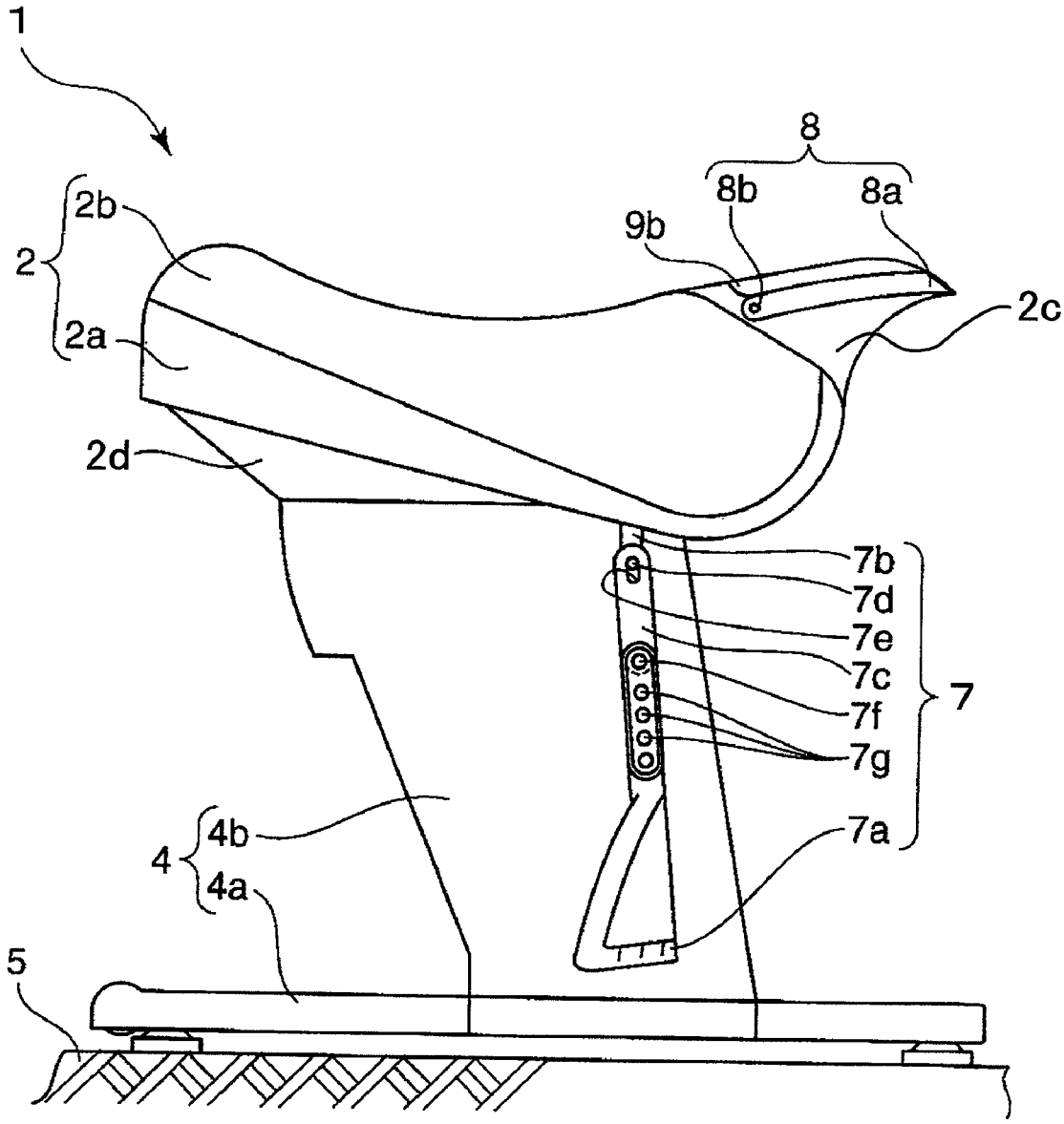
FIG. 1 is a side view showing an entire configuration of a balance exercise machine in accordance with an embodiment of the present invention.
Figure 2:
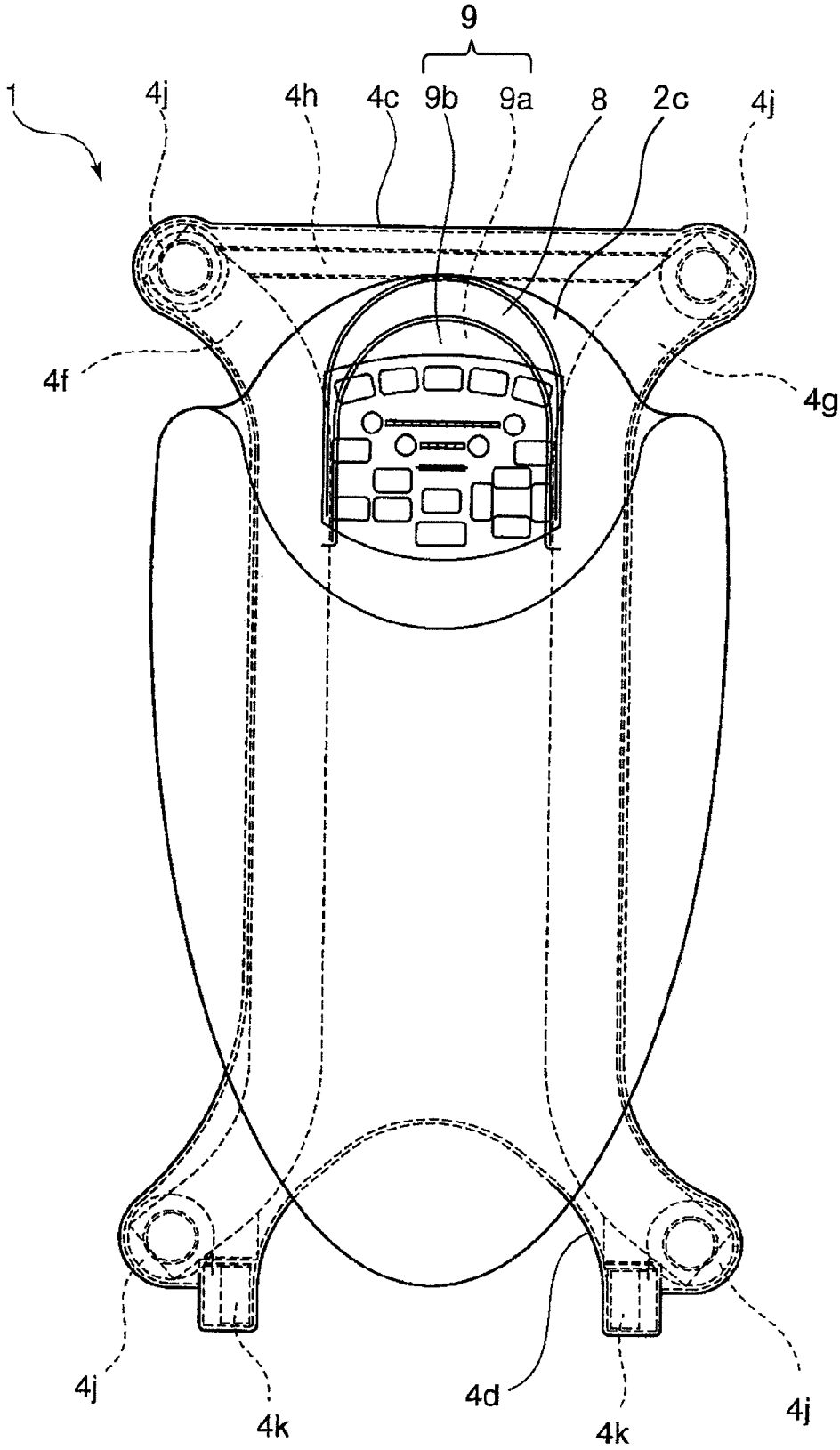
FIG. 2 is a plain view of the balance exercise machine shown in FIG. 1.
Figure 3:
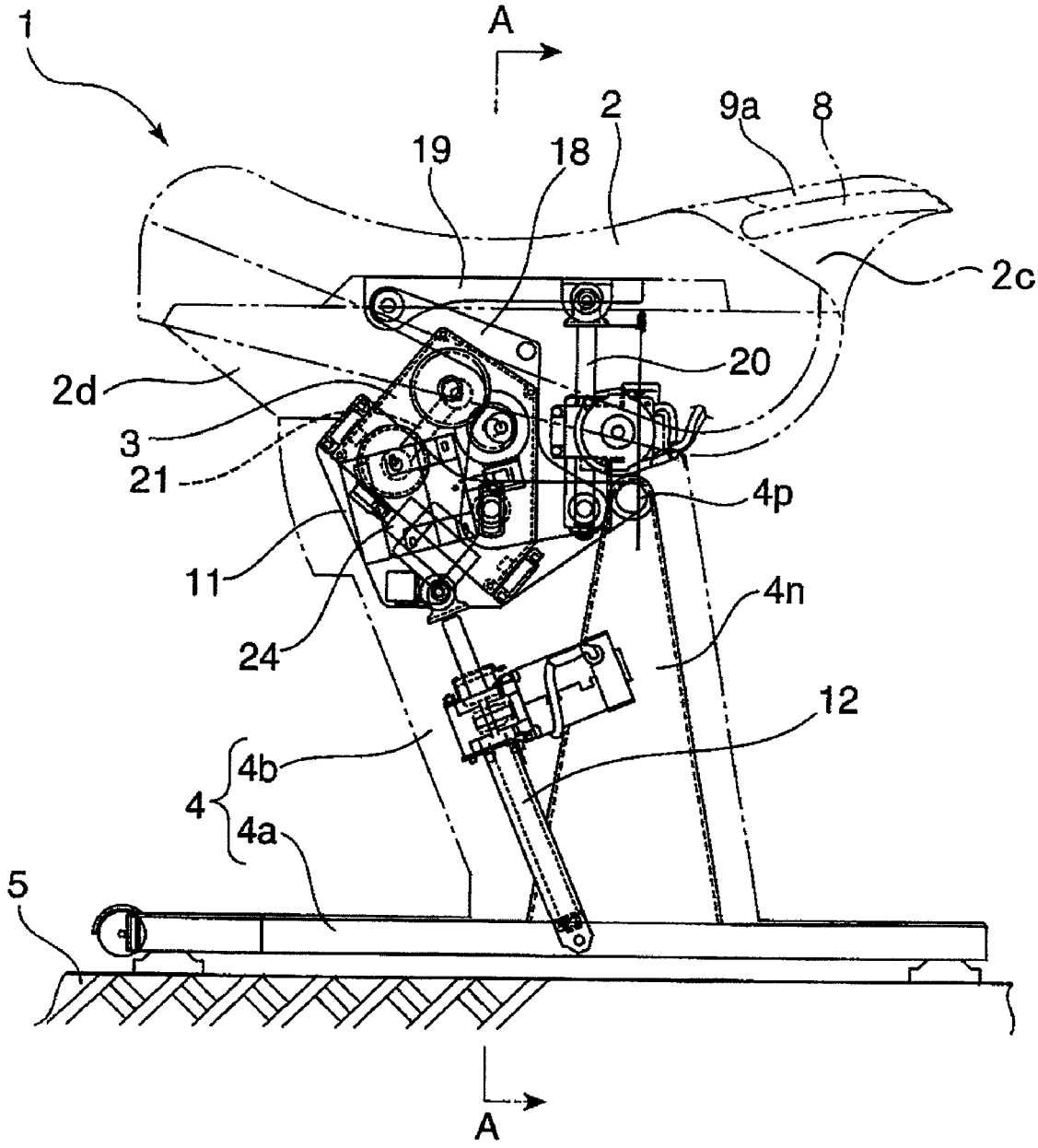
FIG. 3 is a side view showing a configuration of a driving mechanism of the balance exercise machine.
Figure 4:
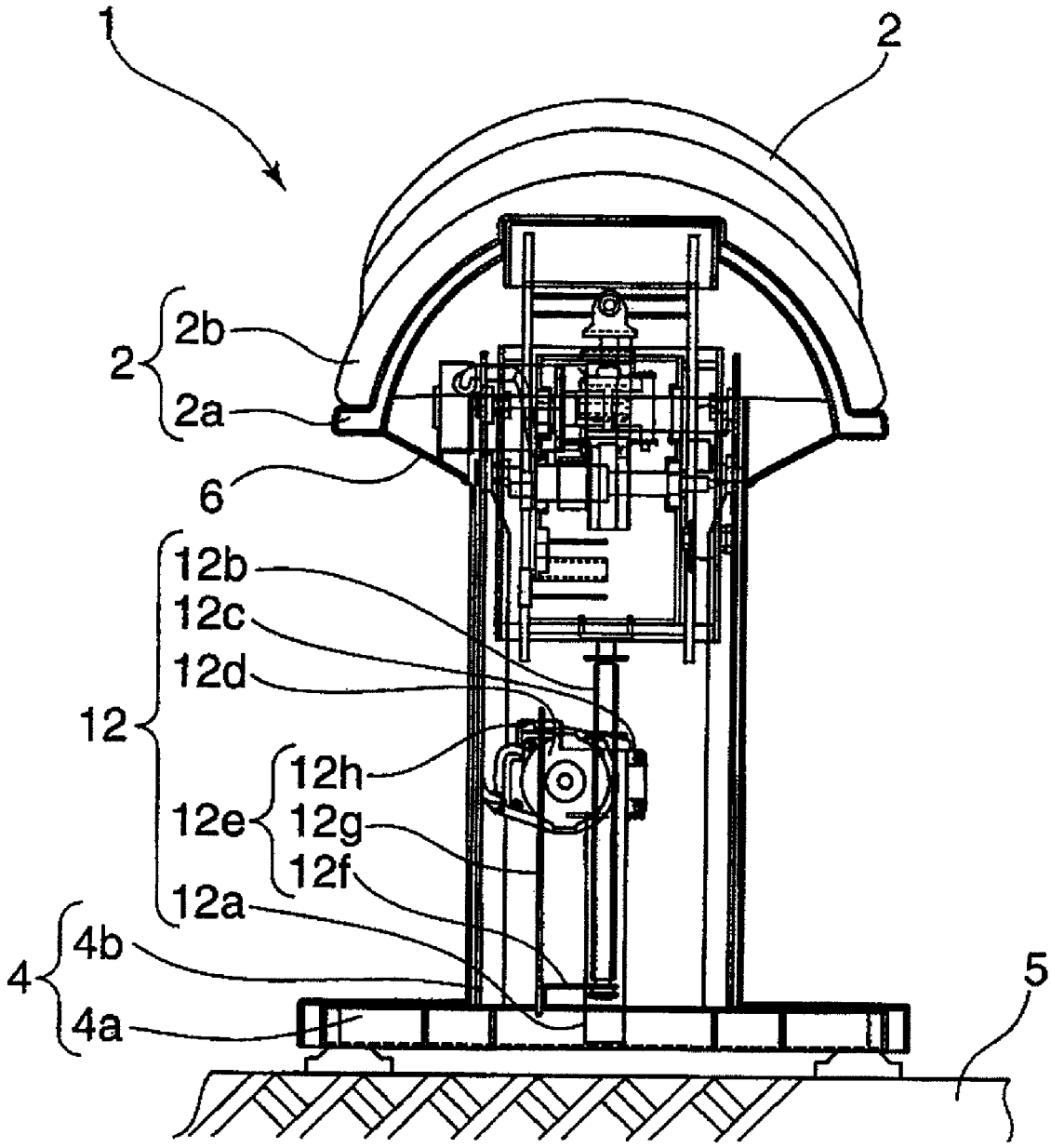
FIG. 4 is a sectional front view along A-A line in FIG. 3 showing the configuration of the driving mechanism.
Figure 5:
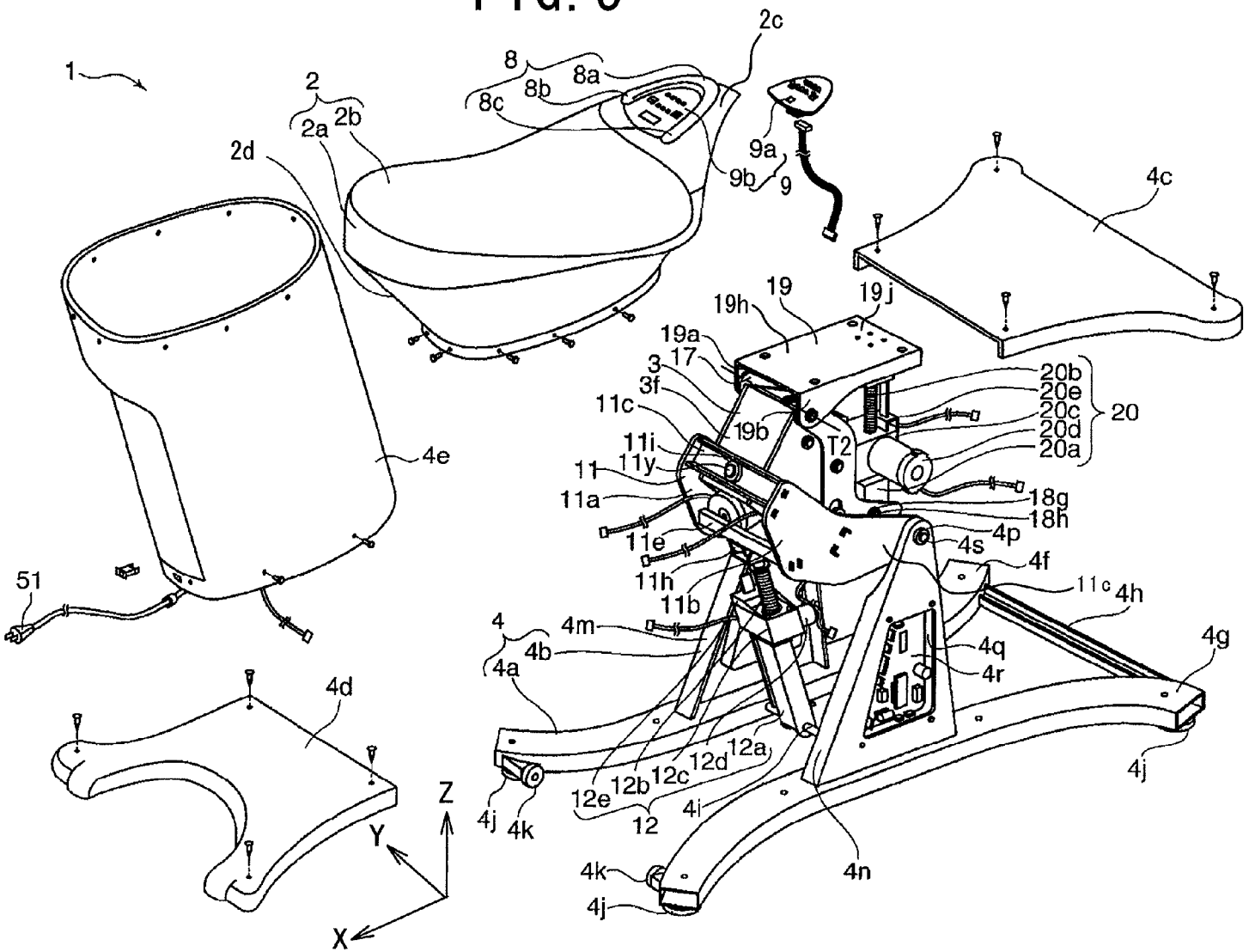
FIG. 5 is an exploded perspective view watched from a right rear side in FIG. 1 showing the configuration of the balance exercise machine.

A balance exercise machine in accordance with an embodiment of the present invention is described with reference to the figures. FIG. 1 shows an entire configuration of a balance exercise machine 1 in accordance with the first embodiment. FIG. 2 is a plain view of the balance exercise machine 1. FIG. 3 shows a configuration of a driving mechanism of the balance exercise machine 1. FIG. 4 is a sectional front view along A-A line in FIG. 3. FIG. 5 is an exploded perspective view of the balance exercise machine 1 watched from a right rear side in FIG. 1.

The balance exercise machine 1 is comprised of a seat 2 which has a substantially horseback shape or a saddle shape and on which a trainee sits and a pedestal 4 which is disposed on a floor 5 and supports the seat 2 and so on. The seat 2 is configured to have a seat base 2*a* and a cushion 2*b* attached to the seat 2*a*.

A pair of stirrups 7 is hung down from both front sides of the seat 2 (in FIGS. 2 to 5, they are omitted so as to simplify the illustration). Each stirrup 7 is comprised of a footrest 7*a* to which the trainee rests his or her toe, a hooking piece 7*b* which is fixed on the seat base 2*a* by, for example, screws, and a coupling piece 7*c* which couples the footrest 7*a* and the hooking piece 7*b*. When a hooking hole 7*e* formed at an upper end of the coupling piece 7*c* is engaged with a pin 7*d* provided at a lower end of the hooking piece 7*b*, the coupling piece 7*c* can be swung. The footrest 7*a* has a plurality of adjusting holes 7*g*, which are aligned along a line, so as to adjust a length of the stirrup 7 (or a height of the foot lest 7*a*) can be adjusted by engaging a pin 7*f* provided at a lower end of the coupling piece with one of the adjusting holes 7*g*.

The seat 2 further has a support base 2*c* provided near to a front end of the seat 2. A bridle rein 8 is provided on the support base 2*c* at a portion near to the front end of the seat 2. The bridle rein 8 has a handle 8*a* having a semicircle shape. Both ends 8*b* and 8*c* of the handle 8*a* are inwardly bended so as to be rotatably borne on the support base 2*s*. Thus, the trainee can hold the handle 8*a* at a side far from the trainee himself or herself by standing up the handle 8*a* from the seat 2. A storage groove having a corresponding shape to the handle 8*a* is formed on an upper face of the support base 2*c*, so that the handle 8*a* can be put in support base 2*c* of the seat 2 by laying the handle 8*a* flat. An operation circuit board 9*a* is mounted on the support base 2*c*, and a front panel 9*b* is further attached to the support base 2*c* so as to enclose the circuit board 9*a*, thereby configuring an operation unit 9.

The pedestal 4 is comprised of a mounting base 4*a* which is established on a floor 5, a column 4*b* which stands up on the mounting base 4*a*, cover members 4*c* and 4*d* which respectively cover front and rear tops of the mounting base 4*a*, and a cover member 4*e* which covers the column 4*b*. The mounting base 4*a* is configured that right and left frames 4*f* and 4*g* are coupled with each other via a coupling frame 4*h* at a portion near to a front end of the mounting base 4*a* and via a coupling bar 4*i* at a center portion of the mounting base 4*a*. Adjustors 4*j* which enables to adjust the height or level of the mounting base 4*a* with respect to the floor 5 are screwed on bottom faces of the right and left frames 4*f* and 4*g* at front and rear ends of the mounting base 4*a*.

A pair of casters 4*k* is further provided on inner faces of the right and left frames 4*f* and 4*g* near to the rear ends the mounting base 4*a*. Thus, when the protruding quantities of the adjusters 4*j* provided at the rear ends of the mounting base 4*a* are decreased and the front end portion of the mounting base 4*a* is lifted up, the balance exercise machine 1 can be moved by rolling the casters 4*k* on the floor 5. Alternatively, when the protruding quantities of the adjusters 4*j* provided at the rear ends of the mounting base 4*a* are increased so as not to contact the casters 4*k* on the floor 5, the balance exercise machine 1 can be held on the floor 5 horizontally and stably without rattling. Thus, the swing mechanism 3 and the seat 2 can be held stably even when the seat 2 is performed the swing motion with the trainee thereon.

The column 4*b* is comprised of a pair of supporting posts 4*m* and 4*n* which are formed substantially triangular shape watched from the sides thereof so as to support the load due to the swing mechanism 3, the seat 2 and the body weight of the trainee. The lower ends of the supporting posts 4*m* and 4*n* are respectively fixed to the right and left frames 4*f* and 4*g* at substantially center portions of the right and left frames 4*f* and 4*g*. A bearing 4*p* is fitted to a portion near to the top end of each of the supporting posts 4*m* and 4*n*. A recess 4*q* is formed at a substantially center of the triangular shape of at least one of the supporting posts 4*m* and 4*n*, so that a main circuit board 4*r* which performs a current supply and a driving control of the balance exercise machine 1 is contained therein. These elements which configure the column 4*b* are covered with the cover member 4*e*, and a space between the top end of the cover member 4*e* and the bottom end of the seat 2 is covered with a retractable cover member 2*d*.

Figure 6:
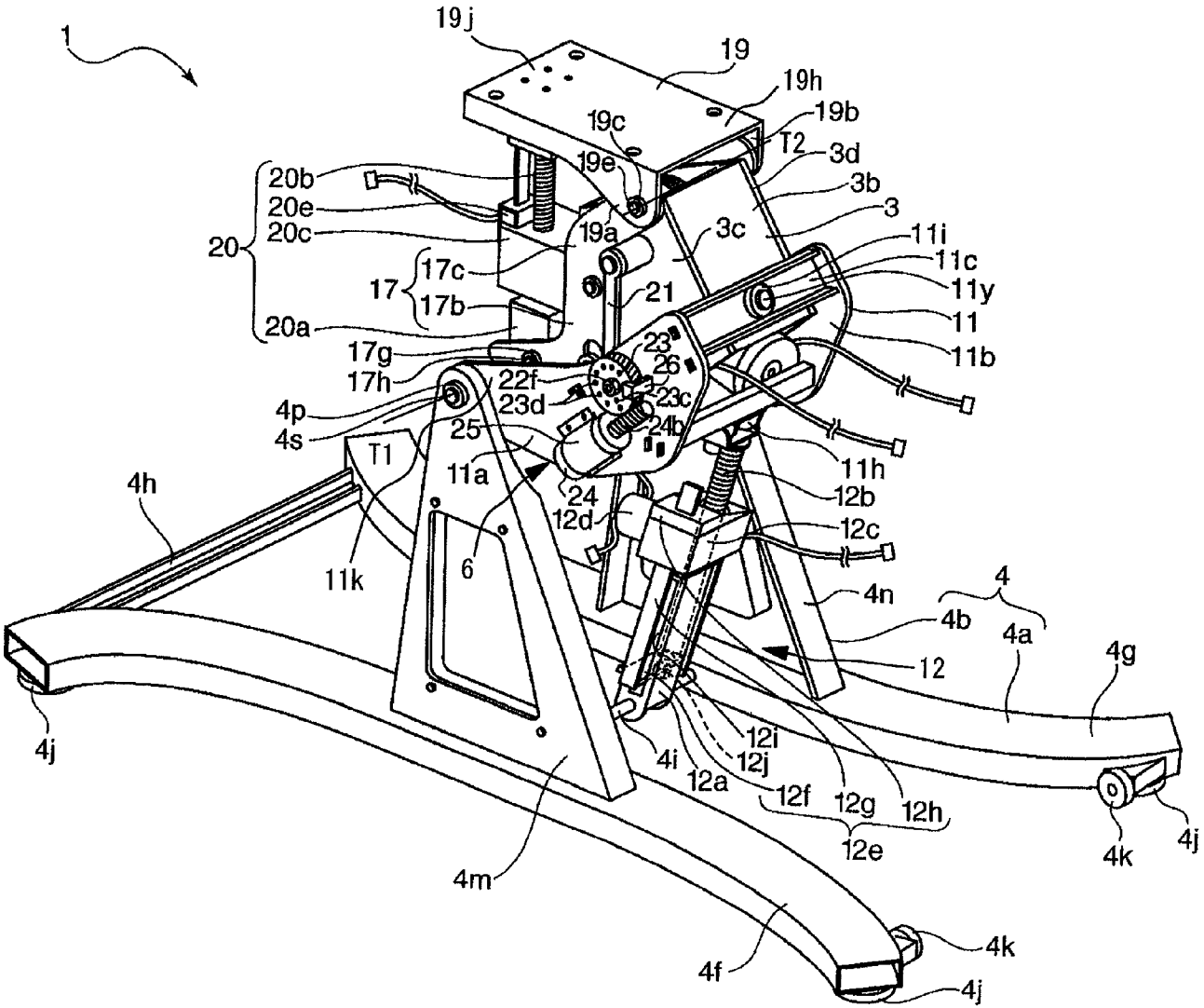
FIG. 6 is a perspective view showing the configuration of the balance exercise machine in which a seat and covers are removed.
Figure 7:
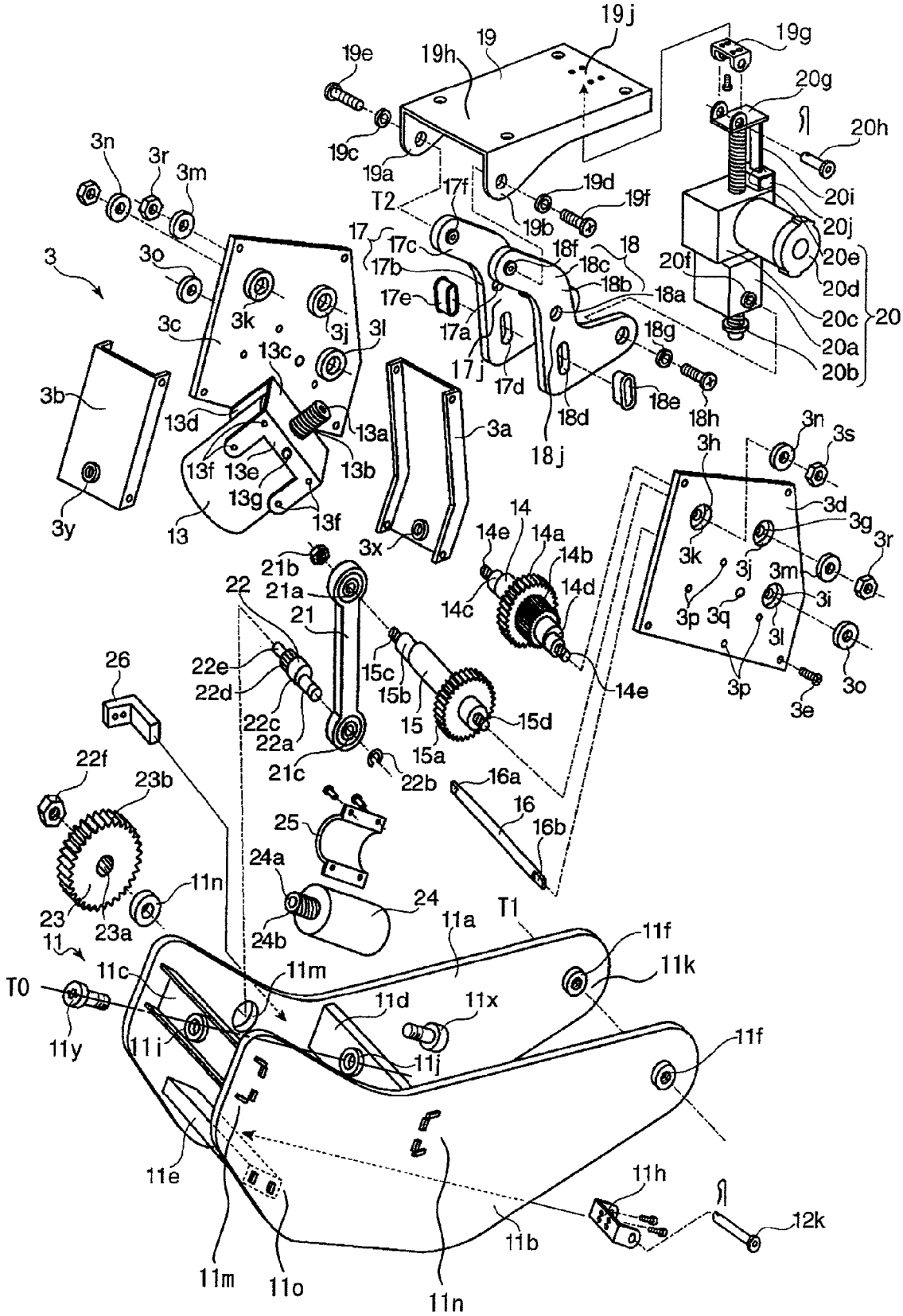
FIG. 7 is an exploded perspective view showing the configuration of a swing mechanism of the seat.
Figure 8:
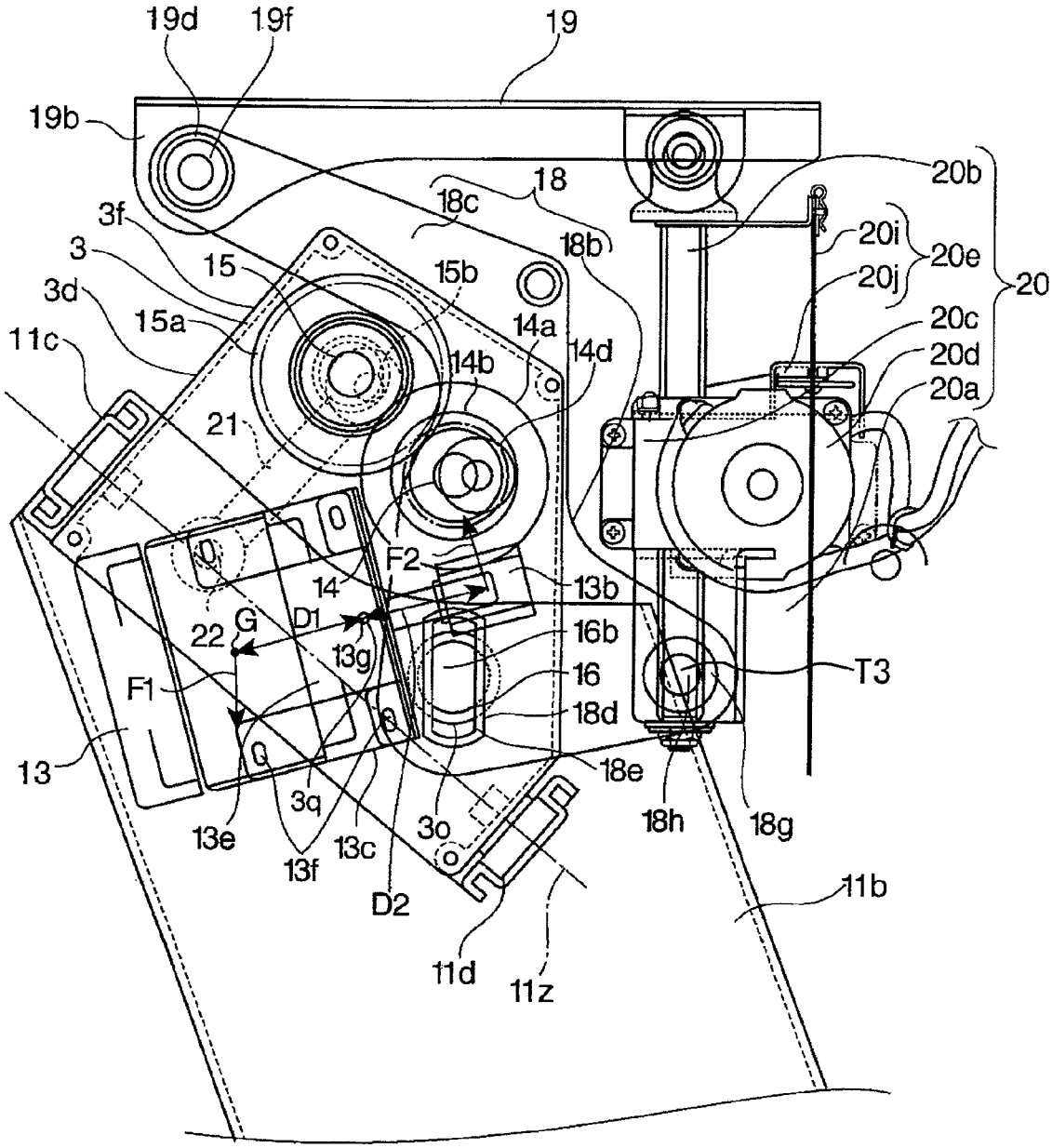
FIG. 8 is a right side view showing the configuration of the swing mechanism.

FIG. 6 shows the configuration of a driving mechanism of the balance exercise machine 1 watched from left rear side thereof, in which the seat 2 and cover members 4*c*, 4*d* and 4*e* are removed from the balance exercise machine 1. FIG. 7 is an exploded perspective view of the driving mechanism. FIG. 8 is a right side view of the driving mechanism.

The driving mechanism of the balance exercise machine 1 is comprised of a swing mechanism 3 that swings the seat 2 in an anteroposterior direction (X-direction) of the balance exercise machine 1, an offset mechanism 6 that offsets the swing mechanism 3 around a rotation axis T0, a first inclination mechanism 12 that is provided between the pedestal 4 and the supporting unit 11, and varies an angular displacement θ (see FIG. 26) of the rotation axis T0 of the swing mechanism 3 in a vertical plane, and a second inclination mechanism 20 that is provided between the swing mechanism 3 and the seat 2 or a seat base 19, and varies an inclination angle of the seat 2.

A supporting unit 11 supports the swing mechanism 3 rotatably around the rotation axis T0. The pedestal 4 supports the supporting unit 11 rotatably around a first horizontal axis *T1. The supporting unit 11 is comprised of a pair of rotation plates 11*a* and 11*b* each of which has a doglegged shape watched from the sides thereof, a first shaft bearing plate 11*c* which couples the rotation plates 11*a* and 11*b* at rear end portions 11*m* of the rotation plates 11*a* and 11*b*, a second shaft bearing plate 11*d* which couples the rotation plates 11*a* and 11*b* at center portions 11*n* of the rotation plates 11*a* and 11*b*, and a lift supporting plate 11*e* which couples the rotation plates 11*a* and 11*b* at bottom portion 11*o* of the rotation plates 11*a* and 11*b*. These supporting plates 11*c*, 11*d* and 11*e* are respectively welded to the rotation plates 11*a* and 11*b*.

A pair of bushings 11*f* each having a female screw is press fitted to the rotation plates 11*a* and 11*b* at front end portions 11*k* of the rotation plates 11*a* and 11*b*. Since screw bolts 4*s* which penetrate through bearings 4*p* provided on the supporting posts 4*m* and 4*n* are screwed to the female screws of the bushings 11*f*, the supporting unit 11 is rotatably borne with the bearings 4*p* around the first horizontal axis *T1 binding the center of the bearings 4*p*.

A bracketing 11*h* is fixed on the lift supporting plate 11*e* at the center thereof, so that the first inclination mechanism 12 such as an extendable and contractible lift is provided between the bracketing 11*h* and the coupling bar 4*i* of the mounting base 4*a* of the pedestal 4. Thus, the inclination angle of the supporting unit 11 in the anteroposterior direction of the balance exercise machine 1 is changeable corresponding to the extension or contraction of the first inclination mechanism 12.

The first shaft bearing plate 11*c* and the second shaft bearing plate 11*d* are disposed to face each other with a predetermined distance, and bearings 11*i* and 11*j* are respectively press fitted at the centers of them. These bearings 11*i* and 11*j* support the swing mechanism 3 to allow the swing motion around the rotation axis T0, details of which will be described later.

The first inclination mechanism 12 is comprised of a cylinder 12*a*, a moving member 12*b* which is extendable and contractible with respect to the cylinder 12*a*, a gearbox 12*c* provided at an upper portion of the cylinder 12*a*, a motor 12*d* that drives the gearbox 12*c*, and a height detection unit 12*e*. A lower end of the cylinder 12*a* is pivoted on the supporting base 4*a* with the coupling bar 4*i* so as to be swung around a horizontal axis. The moving member 12*b* is comprised of such as a ball screw, and an upper end of the moving member 12*b* is pivoted with the bracketing 11*h* and a pin 12*k* so as to be swung around a horizontal axis. A female screw formed on an inner face of a gear (not shown) in the gearbox 12*c* is screwed with the ball screw of the moving member 12*b*, and the gear is driven by a worm fixed on an output shaft of the motor 12*d*, so that the moving member 12*b* is extended from or contracted into the inside of the cylinder 12*a*.

The height detection unit 12*e* is comprised of a slit plate 12*g* which is coupled to a lower end of the moving member 12*b* with a coupling piece 12*f*, and a sensor 12*h* which detects a displacement of the slit plate 12*g*, thereby enabling to measure a height of the lift supporting plate 11*e*, in other words, the inclination angle of the supporting unit 11. The coupling piece 12*f* is inserted into an inside of the cylinder 12*a* from a slit 12*i* and coupled to the lower end of the moving member 12*b* via a screw 12*j*.

The swing mechanism 3 has a compact configuration so as to be contained in a space which is compartmentalized by the rotation plates 11*a* and 11*b* and the supporting plates 11*c*, 11*d* and 11*e*. With reference to FIGS. 7 and 8, the swing mechanism 3 is comprised of a motor 13, a first driving gear 14, a second driving gear 15, a guide shaft 16, and so on, which are contained in a housing 3*f*. The housing 3*f* is configured by fixing side plates 3*c* and 3*d* to a front cover 3*a* and a rear cover 3*b* via screws 3*e*.

The first driving gear 14, the second driving gear 15 and the guide shaft 16 are rotatably pivoted around horizontal axes with bearings 3*m*, 3*n* and 3*o* which are respectively fitted into recesses 3*j*, 3*k* and 31 having bearing holes 3*g*, 3*h* and 3*i*.

The first driving gear 14 has a worm wheel 14*a* having the largest diameter, to which a worm 13*b* is engaged. The worm 13*b* is press fitted to an output shaft 13*a* of the motor 13. A bracketing 13*c* is fixed to the motor 13 by welding or the like. The bracketing 13*c* has screw holes 13*f* formed on side plates 13*d* and 13*e* thereof, and insertion holes 3*p* are formed on the side plates 3*c* and 3*d* corresponding to the screw holes 13*f*. Thus, the motor 13 is fixed to the swing mechanism 3 in a manner so that the above mentioned screws 3*e* which penetrate through insertion holes 3*p* are screwed to the screw holes 13*f*.

A pin 13*g* is provided on each of the side plates 13 *d* and 13*e* at a position distant from center of gravity G of the motor 13. When the housing 3*f* is assembled with containing the first driving gear 14, the second driving gear 15, the guide shaft 16 and the motor 13, these pins 13*g* are fitted into pin holes 3*q* formed on the side plates 3*c* and 3*d*, first. After assembling the housing 3*f*, the motor 13 can be swung via the pins 13*g* and the pin holes 13*g* in a space between the first driving gear 14 and the guide shaft 16. When the assembled housing 3*f* is positioned with using a jig, for example, and when a worker releases the support of the motor 13, the worm 13*b* engages with the worm wheel 14*a* due to a force F2 corresponding to a self weight F1 of the motor 13, as shown in FIG. 8. In the swing mechanism 3, the worm 13*b* contacts the worm wheel 14*a* from beneath. Under such a state, when the worker engages the screws 3*e* so as to fix the motor 13 on the side plates 3*c* and 3*d*, backlash between the worm 13*b* and the worm wheel 14*a* can be adjusted optimally and automatically.

Positions of the pins 13*g* and the pin holes 3*q* are selected on the basis of the weight of the motor 13, the force F2 which is necessary to reduce the backlash between the worm 13*b* and the worm wheel 14*a*, and the posture of the housing 3*f* when it is assembled. For example, assuming that the motor 13 is equipped to the housing in a horizontal direction, a distance from the pin hole 3*q* to the center of gravity G of the motor 13 is designated by a symbol D1, a distance to a point corresponding to an engaging position of the worm 13*b* with the worm wheel 14*a* on the output shaft 13*a* is designated by a symbol D2, the equation of F1×D1=F2×D2 is established.

According to such a configuration, troublesome adjustment of the backlash between the worm 13*b* and the worm wheel 14*a* can be omitted. Furthermore, specific elements such as an adjusting screw to adjust the backlash and a coil spring to apply a pressure becomes unnecessary, so that the manufacturing cost of the balance exercise machine 1 can be reduced. Still furthermore, even when a force to expand the backlash between the worm 13*b* and the worm wheel 14*a* is generated due to increase the load to be driven or due to the loosening of the screws 3*e* or vibration on passage, the force F2 acts on the worm 13*b* to reduce the backlash, so that the acoustic noise due to the backlash can be reduced.

Alternatively, the pins 13*g* may be provided on the side plates 3*c* and 3*c*, and the pin holes 3*q* may be formed on the side plate 13*d* and 13*e* of the bracketing 13*c*. Furthermore, in case that the worm 13*b* engages with the worm wheel 14*a* from above, the pin 13*g* should be provided at a position opposite to the center of gravity G of the motor 13 with respect to the output shaft 13*a* so that the adjustment of the backlash can become unnecessary.

A driving force of the motor 13 is transmitted to the first driving gear 14 through the worm 13*b*. As can be seen from FIG. 7, a pair of eccentric shafts 14*c* and 14*d* is formed on both ends of the first driving gear 14. The eccentric shafts 14*c* and 14*d* are respectively engaged with bearing holes 17*a* and 18*a* which are formed at center portions 17*j* and 18*j* of hoisting levers 17 and 18. Therefore, the driving force of the motor 13 is transmitted to the hoisting levers 17 and 18 through the eccentric shafts 14*c* and 14*d*.

The hoisting levers 17 and 18 are disposed outside of the housing 3*f*. As can be seen from FIGS. 7 and 8, the hoisting levers 17 and 18 are respectively formed sinuously watched from the side thereof. Base end portions 17*b* and 18*b* of the hoisting levers 17 and 18 have substantially L-shape, and the bearing holes 17*a* and 18*a* are respectively disposed at a position corresponding to an end of the L-shape. Free end portions 17*c* and 18*c* of the hoisting levers 17 and 18 are extended obliquely from the end of the L-shape of the base end portions 17*b* and 18*b*.

Elongate guide grooves 17*d* and 18*d* are respectively formed at a portion of the corner of the L-shape of the hoisting levers 17 and 18. On the other hand, the guide shaft 16 has coupling protrusions 16*a* and 16*b* formed at both ends thereof, and the coupling protrusions 16*a* and 16*b* are respectively engaged with elongate bearing members 17*e* and 18*e* which are further inserted into the elongate guide grooves 17*d* and 18*d*. Thus, the hoisting levers 17 and 18 can be moved in the vertical direction but cannot be moved in the horizontal direction relative to the guide shaft 16. Thus, the rotation of the hoisting levers 17 and 18 with respect to the first driving gear 14 is restricted by the guide shaft 16.

Figure 9:
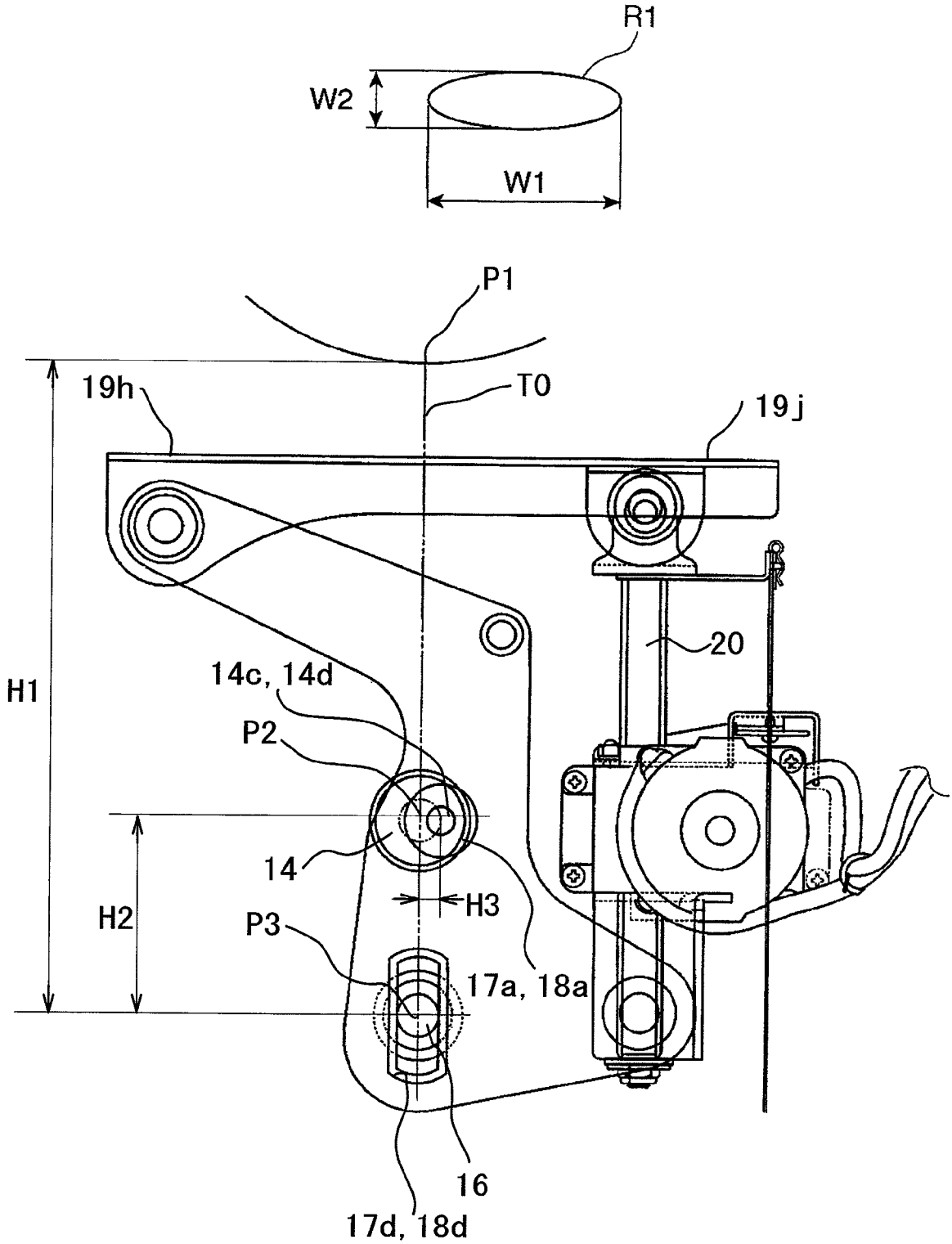
FIG. 9 is a side view showing a relation between a center of the seat and the centers of an eccentric shaft and a guide shaft, and a trace of a swing motion of the center of the seat.

Hereupon, it is assumed that a distance between the center P1 of the seat 2 and the center P3 of the guide shaft 16 is designated by a symbol H1, a distance between the center P2 of the first driving gear 14 and the center P3 of the guide shaft 16 is designated by a symbol H2 and a quantity or stroke of the eccentricity of the eccentric shafts 14*c* and 14*d* is designated by a symbol H3 as shown in FIG. 9. Since the center P1 of the seat 2 is disposed on a line T10 which binds the centers P2 and P3 of the first driving gear 14 and the guide shaft 16, even when the eccentric shaft 14*c* and 14*d* rotate around the center P2 of the first driving gear 14, the displacement of the center P1 of the seat 2 in the vertical direction becomes substantially twice of the quantity of the eccentricity H3. In contrast, the displacement of the center P1 of the seat 2 in the horizontal direction is expanded to H3×H1/H2. When the distance H1 is larger than twice of the distance H2, the center of the seat 2 is moved to draw an elliptic orbit R1 having a major axis in the horizontal direction observed from the sides thereof corresponding to the rotation of the eccentric shafts 14*c* and 14*d* of the first driving gear 14. When the line T10 binding the centers is inclined, allocation of the displacements of the center of the seat 2 in the horizontal direction and in the vertical direction can be extended or contracted, so that the ratio of the major axis and the minor axis of the elliptic orbit can be varied.

In addition, male screws 14*e* are formed on both ends of the eccentric shafts 14*c* and 14*d* penetrating through the bearings 3*m* and the bearing holes 17*a* and 18*a* of the hoisting levers 17 and 18 and nuts 3*r* are screwed to the male screws 14*e*, so that the engagement of the eccentric shafts 14*c* and 14*d* of the first driving gear 14 with the bearing holes 17*a* and 18*a* of the hoisting levers 17 and 18 are retained.

The guide shaft 16 has an outer diameter corresponding to an inner diameter of the bearing 3*o*, so that the guide shaft 16 is slidable along the horizontal center axis thereof. However, both ends of the guide shaft 16, that is, the coupling protrusions 16*a* and 16*b* are respectively engaged with the elongate guide grooves 17*d* and 18*d* via the elongate bearing members 17*e* and 18*e*. Thus, the movement of the guide shaft 16 in the horizontal direction is restricted.

Instead of the guide shaft 16 and the elongate guide grooves 17*d* and 18*d*, a known kink mechanism can be used to reciprocally moving the hoisting levers 17 and 18. Furthermore, the shape of the guide grooves 17*d* and 18*d* is not limited to the elongate straight, and it may be modified such as a circular arc or a combination of circular arcs having different radiuses corresponding to the required orbit of the seat 2. Still furthermore, the guide grooves 17*d* and 18*d* may be formed in a horizontal direction or slanted in a predetermined direction.

Figure 25:
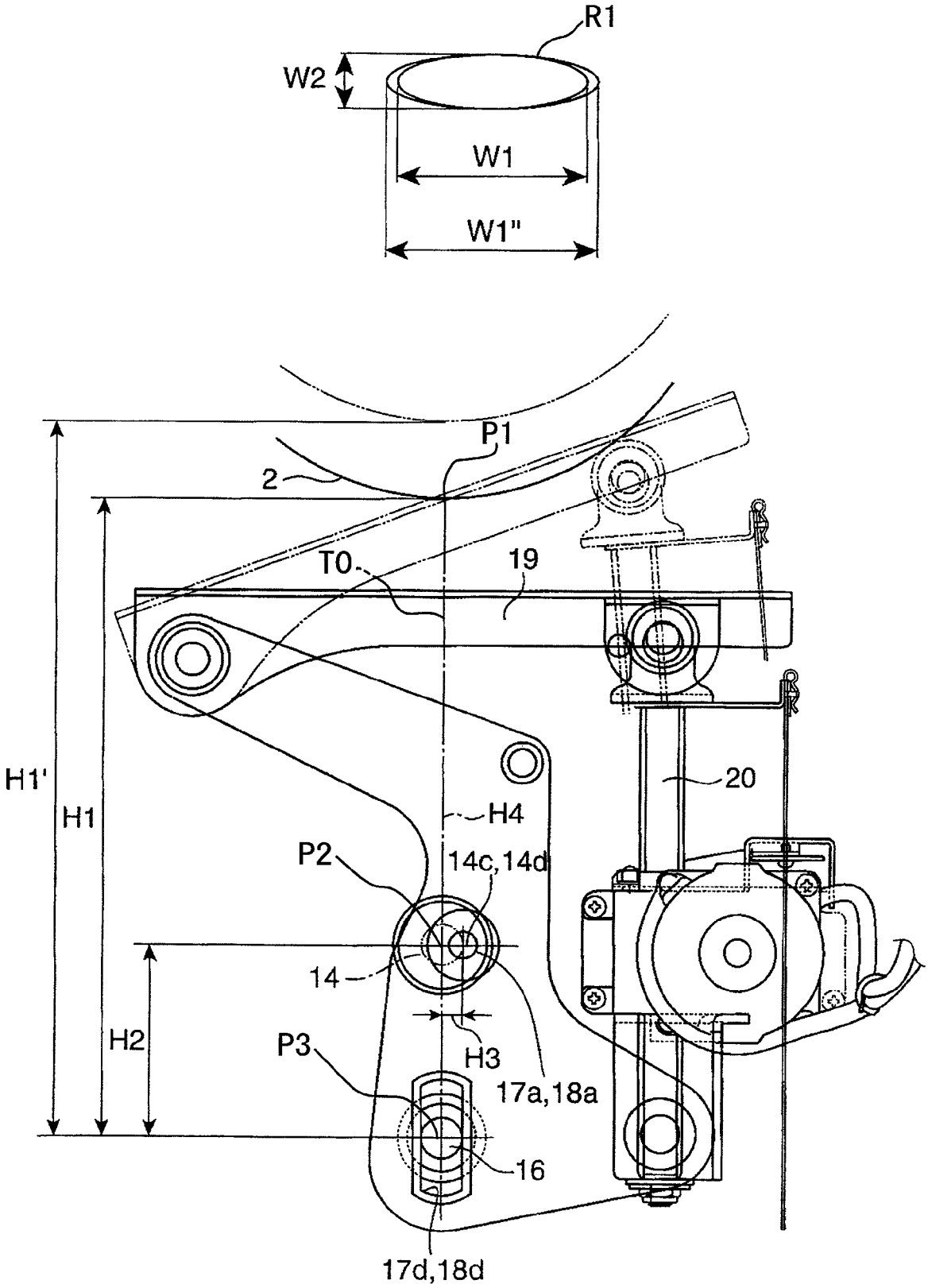
FIG. 25 is a side view showing a relation between the center of the seat and the centers of the eccentric shaft and the guide shaft when a second inclination mechanism for inclining the seat is extended, and traces of swing motions of the center of the seat before and after extending the second inclination mechanism.

Hereupon, when a distance between the center P1 of the seat 2 and the center P3 of the guide shaft 16 is designated by a symbol H1, a distance between the center P2 of the first driving gear 14 and the center P3 of the center of the guide shaft 16 is designated by a symbol H2 and a quantity or stroke of the eccentricity of the eccentric shafts 14*c* and 14*d* is designated by a symbol H3 as shown in FIG. 25, the quantity of the eccentricity H3 is expanded to H3×H1/H2. When the line T10 binding these centers is inclined, allocation of the strokes in the horizontal direction and in the vertical direction can be varied, so that the quantity of the eccentricity H3 can be expanded or contracted.

Bushings 17*f* and 18*f* each having a female screw are press fitted to the free end portions 17*c* and 18*c* of the hoisting levers 17 and 18. On the other hand, a seat base 19, to which the seat 2 is mounted, has a pair of brackets 19*a* and 19*b*, and bearings 19*c* and 19*d* are press fitted to the brackets 19*a* and 19*b* at portions near to the rear ends thereof. Bolts 19*e* and 19*f* respectively penetrating through the bearings 19*c* and 19*d* are screwed to the inner screws of the bushings 17*f* and 18*f*. Thus, the rear end 19*h* of the seat base 19 is rotatably pivoted around a second horizontal axis T2. On the other hand, a bracket 19*g* is fixed at a front end portion 19*j* of the seat base 19. The bracket 19*g* and the free end portion 17*c* and 18*c* of the hoisting levers 17 and 18 are linked with a second inclination mechanism 20 such as an extendable and contractible lift.

The second inclination mechanism 20 is configured similar to the first inclination mechanism 12 mentioned above, and comprised of a cylinder 20*a*, a moving member 20*b* which is extendable and contractible with respect to the cylinder 20*a*, a gearbox 20*c* provided at an upper portion of the cylinder 20*a*, a motor 20*d* that drives the gearbox 20*c*, and a height detection unit 20*e*. A pair of bushings 20*f* each having an inner screw is press fitted to at portions near to bottom ends of both side faces of the cylinder 20*a*. On the other hand, a pair of bearings 17*g* and 18*g* is respectively press fitted at portions near to the front ends of the hoisting levers 17 and 18. Bolts 17*h* and 18*h* penetrating through the bearings 17*g* and 18*g* are screwed to the bushings 20*f*, so that the lower end of the second inclination mechanism 20 is rotatably pivoted around a third horizontal axis T3 binding the bearings 17*g* and 18*g*.

The moving member 20*b* is comprised of such as a ball screw, and a bracket 20*g* is fixed on an upper end of the moving member 20*b*. The bracket 20*g* is rotatably pivoted on the bracket 19*g* of the seat base 19 via a pin 20 around a horizontal axis. The ball screw of the moving member 20*b* is screwed to a female screw formed on an inner face of a gear (not shown) provided inside of the gearbox 20*d*. When the gear is driven by a worm fixed on an output shaft of the motor 20*d*, the moving member 20*b* is expanded from or contracted into the cylinder 20*a*, and thereby, the seat base 19 is rotated around the second horizontal axis T2 mentioned above. In other words, an inclination angle of the seat 2 mounted on the seat base 19 is varied in a vertical plane including the antero-posterior direction of the balance exercise machine 1. The height detection unit 20*e* measures a displacement of a slit plate 20*i* which is coupled with the bracket 20*g* so as to detect a height of the front end of the seat base 19, that is, the inclination angle of the seat base 19.

In the above mentioned swing mechanism 3, the driving force of the motor 13 which is transmitted to the first driving gear 14 through the worm 13*b* is further transmitted to the second driving gear 15 through a gear 14*b* having a smaller diameter. An eccentric shaft 15*b* is formed on an end of the second driving gear 15. The eccentric shaft 15*b* penetrating through the bearing 3*n* provided on the side plate 3*c* is fitted into a swivel bearing 21*a* which is provided on an end of an eccentric rod 21. A male screw 15*c* is formed on an end of the eccentric shaft 15*b* and a nut 21*b* is screwed to the outer screw 15*c*, so that the eccentric shaft 15*b* may not be pulled out from the swivel bearing 21*a*. A male screw 15*d* is further formed on the other end of the second driving gear 15 and a nut 3*s* is screwed to the outer screw 15*d*, so that the other end of the second driving gear 15 may not be dropped out from the housing 3*f* of the driving mechanism 3.

The swivel bearing 21*a* has a spherical bearing face, and a similar swivel bearing 21*c* is provided at another end of the eccentric rod 21. An eccentric shaft 22*a* formed on an end of a driving shaft 22 is inserted into the swivel-bearing 21*c*, and an E-shaped ring 22*b* is engaged with the end of the eccentric shaft 22*a*, so that the eccentric shaft 22*a* may not be pulled out from the swivel bearing 21*c*. A center portion 22*c* of the driving shaft 22 is pivoted with a bearing 11*n* which is press fitted to a hole 11*m* formed at a rear end portion of the rotation plate 11*a*. External teeth 22*d* are formed on the other end of the driving shaft 22.

The external teeth 22*d* are engaged with inner teeth 23*a* which are formed on an inner face of a gear 23. The gear 23 is disposed outside of the rotation plate 11. A male screw 22*e* is formed on an end of the driving shaft 22 opposite to the eccentric shaft 22*a* and a nut 22*f* is screwed to the male screw 22*e*, so that the gear 23 is integrally connected to and rotated with the driving shaft 22. The gear 23 is engaged with a worm 24*b* press fitted to an output shaft 24*a* of a motor 24. The motor 24 is fixed on the rotation plate 11*a* at a concave portion formed from the outside with a fixing member 25.

Rotation angle of the gear 23 is detected by an encoder 26. As shown in FIG. 6, the encoder 26 detects reference pits 23*c* which are formed at even intervals on an end face of the gear 23, and outputs a signal corresponding to detection of each reference pit 23*c*. By counting a number of signals outputted from the encoder 26 during the rotation of the gear 23, it is possible to detect the basic point of a swing motion of the eccentric rod 21, details of which will be described later.

The above mentioned eccentric rod 21, the driving shaft 22, the gear 23, the motor 24, and so on constitute the offset mechanism 6. The offset mechanism 6 is provided on the supporting unit 11.

Lower ends of the front cover 3*a* and the rear cover 3*b* are formed to be parallel to each other. Bushings 3*x* and 3*y* each having a female screw are respectively press fitted at centers of portions near to the lower ends of the front cover 3*a* and the rear cover 3*b*. Screw bolts 11*x* and 11*y* penetrating through the bearings 11*j* and 11*i* are screwed to the bushings 3*x* and 3*y*, so that the housing 3*f*, that is, the swing mechanism 3 can be rotatably held around the rotation axis T0 binding the bearings 11*j* and 11*i*. When the second driving gear 15 is rotated, the swing mechanism 3 is swung around the rotation axis T0 owing to the function of the eccentric shaft 15*b* and the eccentric rod 21. During the swing motion of the swing mechanism 3, the eccentric rod 21 displaces to close in and depart from the side plate 3*c*, even if the motor 24 of the second swing mechanism 6 is not driven. The eccentric rod 21, however, may not be disengaged from the second driving gear 15 and the driving shaft 22 owing to the swivel bearings 21*a* and 21*c*.

When the motor 24 of the second swing mechanism 6 is driven, the gear 23 and the driving shaft 22 which is integrally fixed to the gear 23 are rotated by the driving force of the motor 24. Since the lower end of the eccentric rod 21 is engaged with the eccentric shaft 22*a* of the driving shaft 22 via the swivel bearing 21*c*, the base point of the swing motion of the eccentric rod 21 is displaced up and down in the vertical direction shown by arrow Z (direction Z). Accordingly, it is possible to provide an offset to the angular position of the swing mechanism 3 relative to the supporting unit 11 around the rotation axis T0, so that the swing mechanism 3, that is, the seat 2 can be swung around the rotation axis T0 with respect to a basic point which is slanted with a predetermined angle around the rotation axis T0, details of which will be described later. In addition, since the eccentric shaft 22*a* is driven through the worm 24*b* and the gear 23, it is possible to prevent to vary the inclination angle due to the load.

In the balance exercise machine 1 configured as above, when the motor 13 is driven, the seat 2 is reciprocally moved in the anteroposterior direction (direction X) and in the vertical direction (direction Z) due to the functions of the eccentric shafts 14*c* and 14*d* of the first driving gear 14, the hoisting levers 17 and 18, and the guide shaft 16, so that the movement of the seat 2 becomes elliptic orbit R1 when it is watched from the side, as shown in FIG. 9. Since the hoisting levers 17 and 18 supporting the seat base 19 on which the seat 2 is mounted are driven by a single first driving gear 14, it is possible to move the seat 2 to draw the elliptic orbit R1 by adding the reciprocal up and down motion in the vertical direction (direction Z) to the reciprocal forward and backward motion in the anteroposterior direction (direction X), thereby enabling to increase the patterns of the motion of the exercise. Furthermore, the swing mechanism 3 for performing the swing motion of the seat 2 can be simplified and downsized. Still furthermore, since the reciprocal up and down motion is further added to the conventional reciprocal forward and backward motion, autonomic nerves of the trainee can be activated, and muscle strength of leg portions of the trainee can be developed. Still furthermore, since the seat 2 is moved to draw a circular orbit or elliptic orbit watched from the side, burden to the human body due to the swing motion can be varied smoothly, and thereby, effect of the exercise can be enhanced with reducing damage to the human body.

Figure 10:
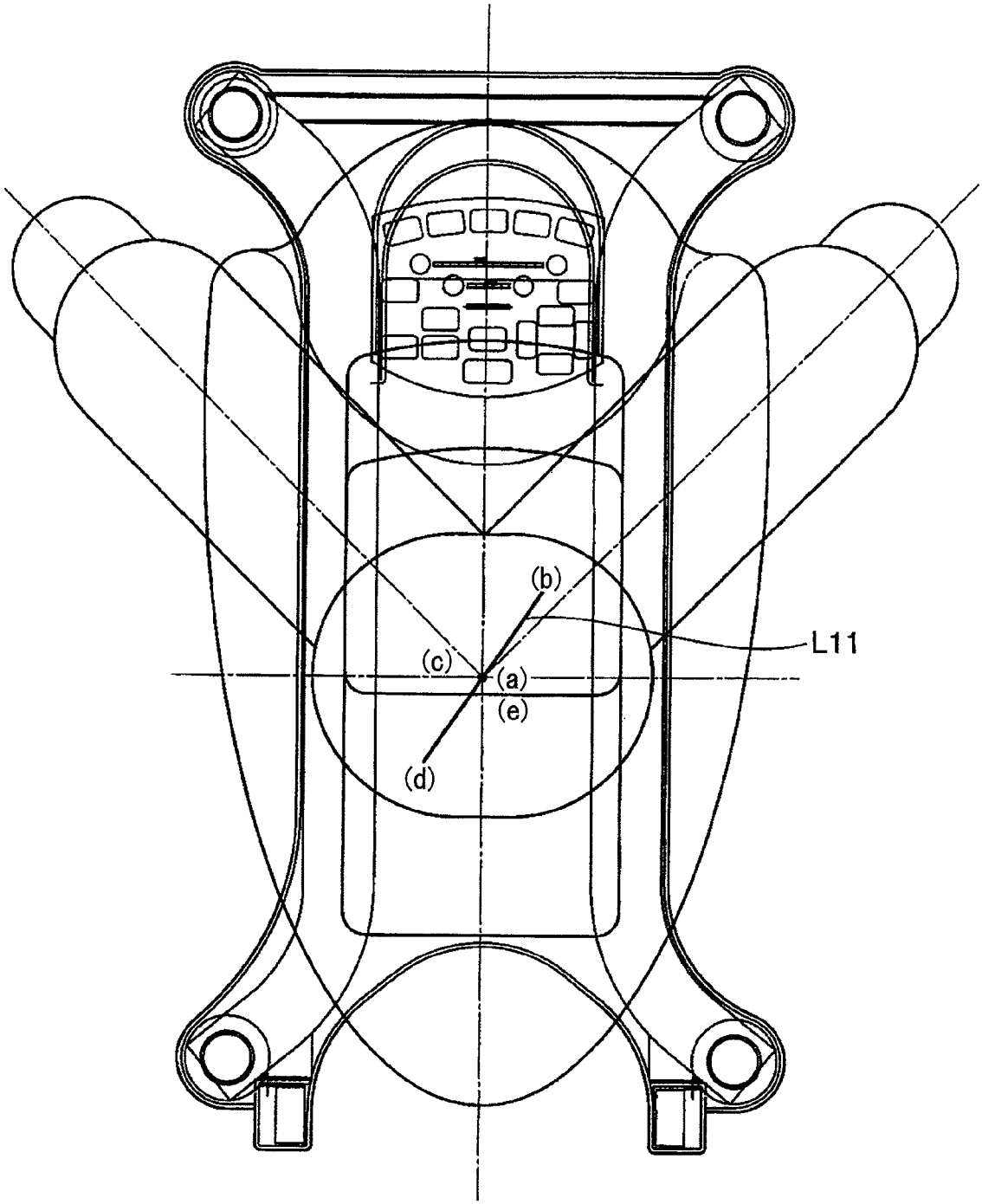
FIG. 10 is a plain view showing a trace of the swing motion of the center of the seat when a gear ratio of a first driving gear to a second driving gear is 1:1 and when timing of an origin of a swing motion in an anteroposterior direction is coincided with an origin of a swing motion in a widthwise direction at 0 degree.
Figure 11:
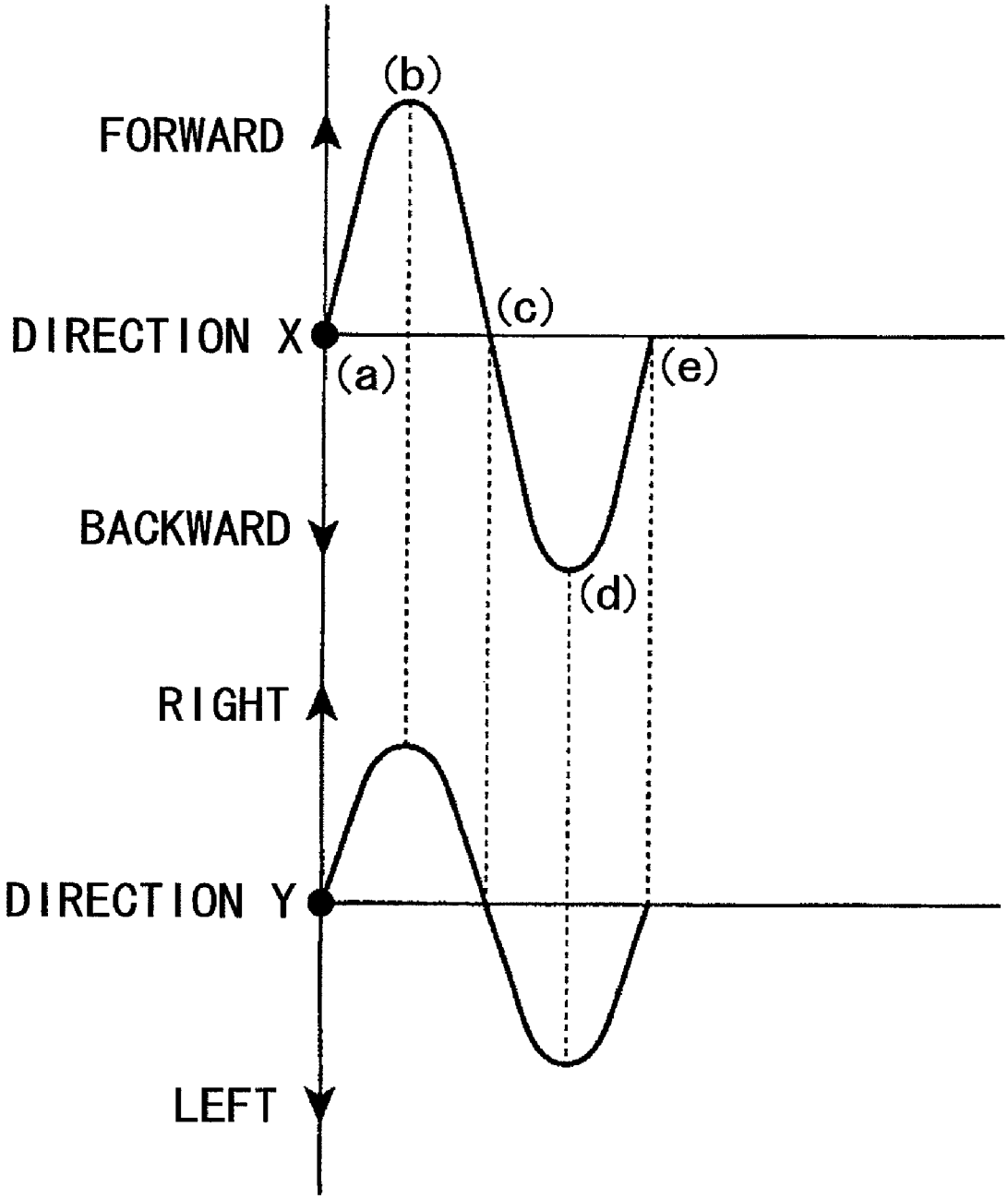
FIG. 11 is a graph showing a relation between a phase of the swing motion in the anteroposterior direction and a phase of the swing motion in the widthwise direction in the case shown in FIG. 10.

Hereupon, when it is assumed that the gear ratio of the gear 14*b* of the first driving gear 14 to the gear 15*a* of the second driving gear 15 is set to be 1:1, the ratio of the rotation speed of the first driving gear 14 to the second driving gear 15 also becomes 1:1. Furthermore, it is assumed that the timing of the origin of the swing motion in the anteroposterior direction (direction X) due to the driving force of the first driving shaft 14 is coincided with the origin of the swing motion in the widthwise direction shown by arrow Y (hereinafter, abbreviated as direction Y) due to the driving force of the second driving shaft 15 at 0 degree, as shown in FIG. 11. In other words, the phase of the eccentric shafts 14*c* and 14*d* of the first driving shaft 14 coincides with the phase of the eccentric shaft 15*b* of the second driving shaft 15. The trace of the motion of the center of the seat 2 becomes a straight line L11, as shown in FIG. 10. The points "a" to "e" in FIGS. 10 and 11 show the positions of the center P1 of the seat 2 in the swing motion. When the swing motion due to the driving force of the second driving shaft 15 is delayed 180 degrees from the phase of the swing motion due to the driving force of the first driving shaft 14, only the direction of the swing motion of the seat 2 is differed but the trace of the motion of the center of the seat 2 becomes a straight line.

Figure 12:
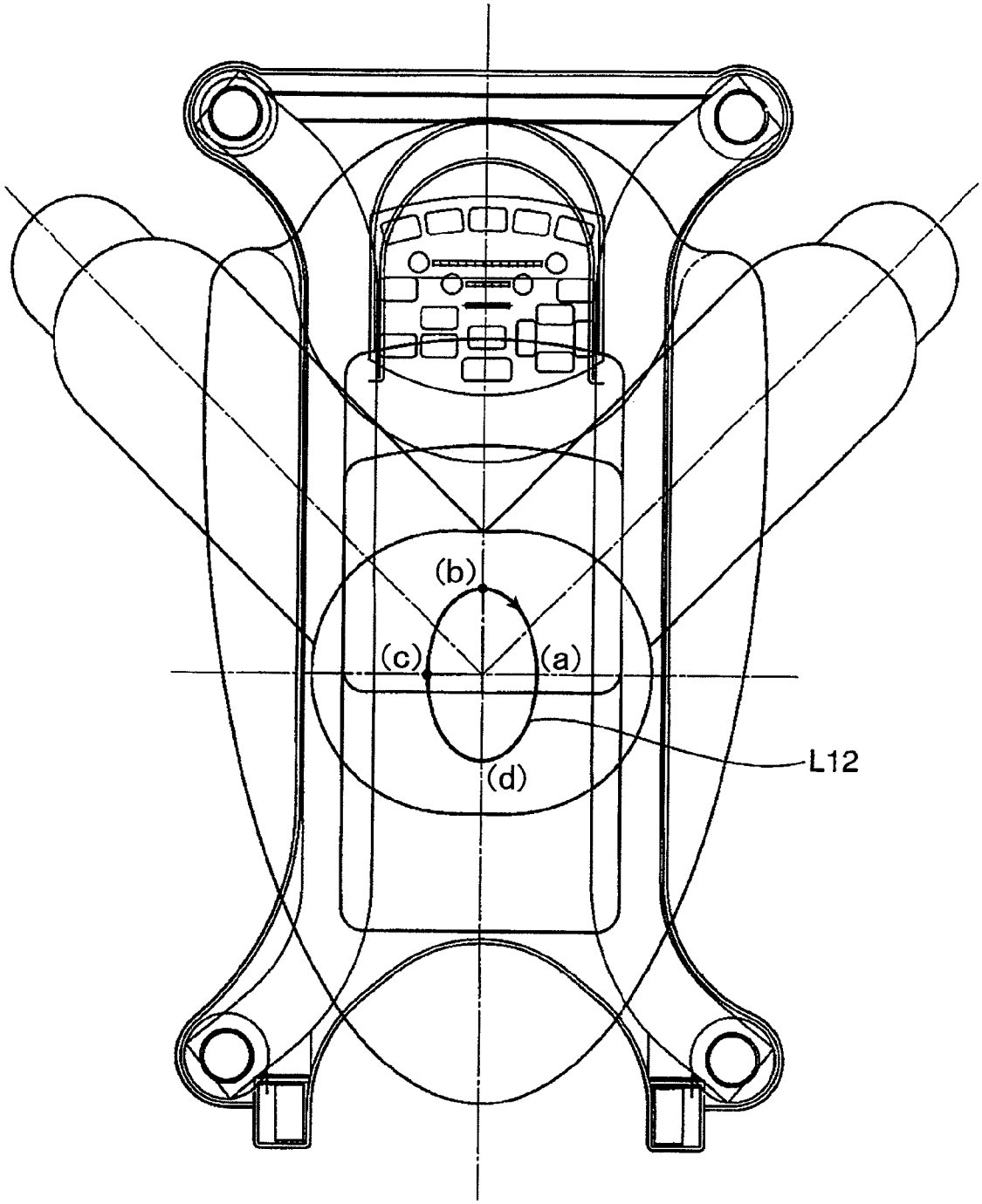
FIG. 12 is a plain view showing a trace of the swing motion of the center of the seat when the gear ratio of the first driving gear to the second driving gear is 1:1 and when timing of the origin of the swing motion in the anteroposterior direction is discrepant 90 degrees from the origin of the swing motion in the widthwise direction.
Figure 13:
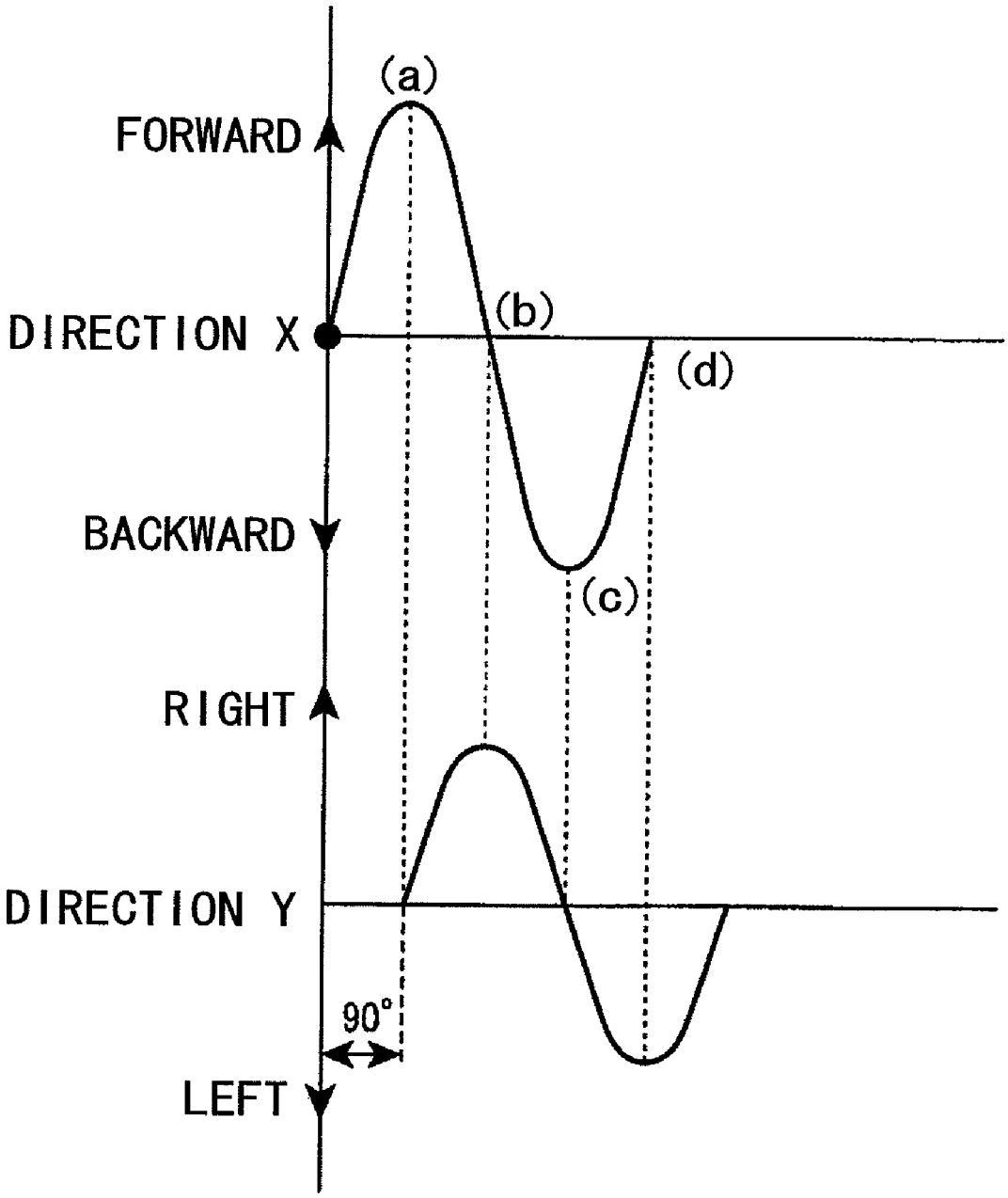
FIG. 13 is a graph showing a relation between a phase of the swing motion in the anteroposterior direction and a phase of the swing motion in the widthwise direction in the case shown in FIG. 12.

Alternatively, when it is assumed that the phase of the eccentric shafts 14*c* and 14*d* of the first driving shaft 14 is discrepant ¼ cycle, that is, 90 degrees from the phase of the eccentric shaft 15*b* of the second driving shaft 15, the trace of the center of the seat 2 becomes an elliptic orbit L12 watched from above due to the swing motion of the eccentric rod 21, as shown in FIG. 12. FIG. 13 shows the waveforms of the swing motion due to the first driving gear 14 and the second driving gear 15 in the example shown in FIG. 12. FIGS. 12 and 13 respectively show the case that the phase of the swing motion due to the driving force of the second driving shaft 15 is delayed 90 degrees from the swing motion due to the driving force of the first driving shaft 14. Even when the swing motion due to the driving force of the second driving shaft 15 is advanced 90 degrees to, that is, delayed 270 degrees from the phase of the swing motion due to the driving force of the first driving shaft 14, the trace of the center of the seat 2 becomes an elliptic orbit that the starting point is different.

When the discrepancy between the phase of the swing motions due to the driving force of the first driving shaft 14 and the phase of the swing motions due to the driving force of the second driving shaft 15 is other than those mentioned above, the trace of the center of the seat 2 is composition of the displacement in the anteroposterior direction due to the first driving shaft 14 and the displacement in the widthwise direction due to the second driving gear 15 with a rate of the discrepancy.

Figure 14:
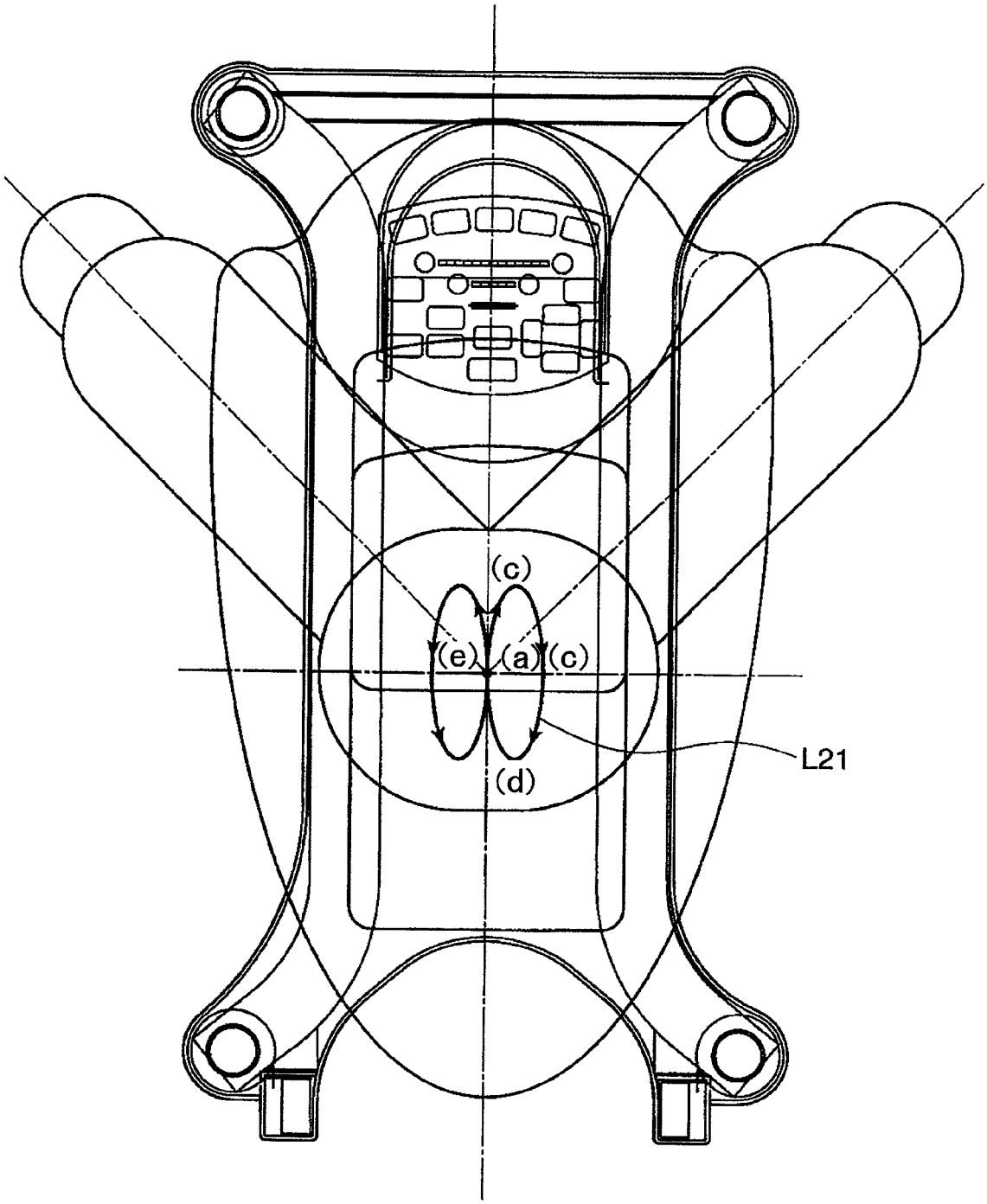
FIG. 14 is a plain view showing a trace of the swing motion of the center of the seat when the gear ratio of the first driving gear to the second driving gear is 1:2 and when timing of the origin of the swing motion in the anteroposterior direction is coincided with the origin of the swing motion in the widthwise direction at 0 degree.
Figure 15:
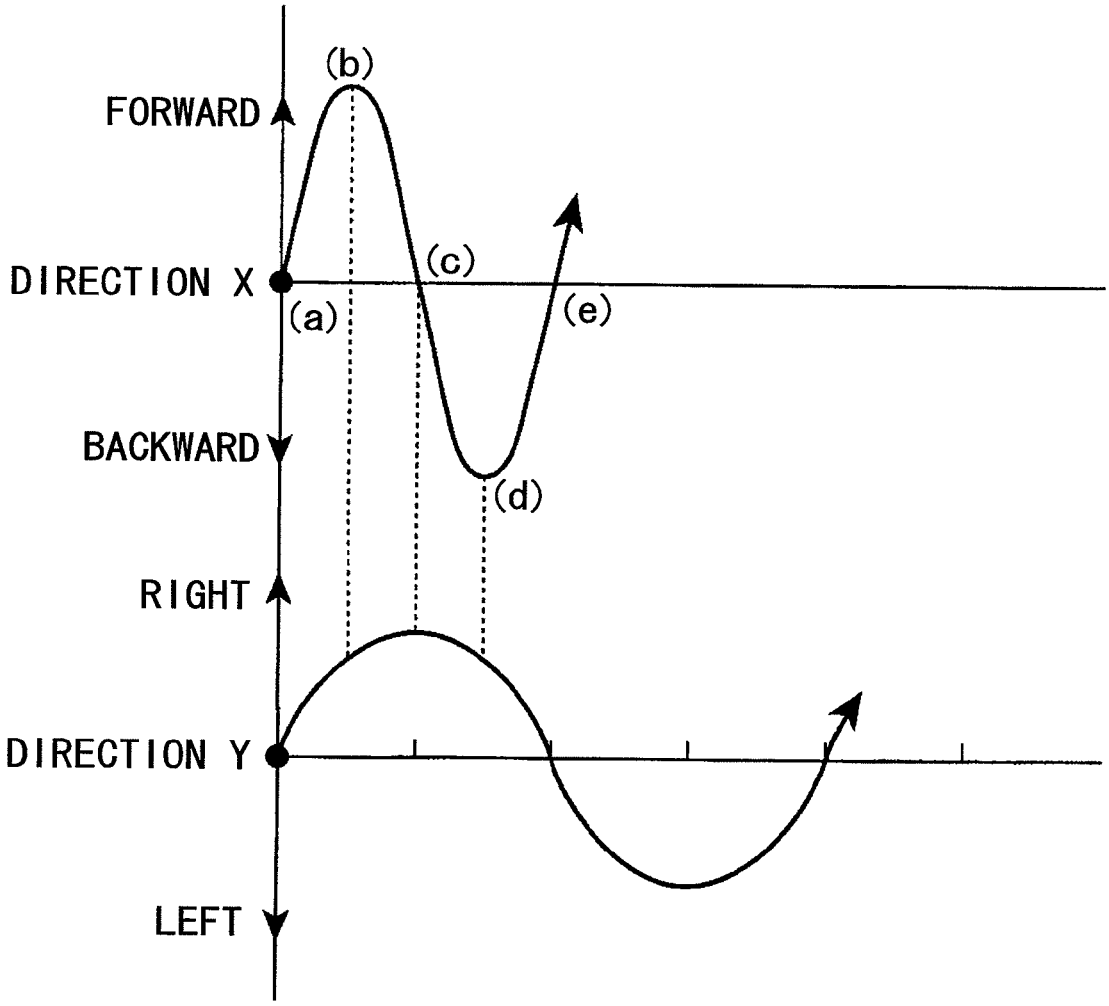
FIG. 15 is a graph showing a relation between a phase of the swing motion in the anteroposterior direction and a phase of the swing motion in the widthwise direction in the case shown in FIG. 14.

On the other hand, when it is assumed that the gear ratio of the gear 14*b* of the first driving gear 14 to the gear 15*a* of the second driving gear 15 is set to be 1:2, the ratio of the first driving gear 14 to the rotation speed of the second driving gear 15 becomes 2:1. Furthermore, it is assumed that the timing of the origin of the swing motion due to the driving force of the first driving shaft 14 is coincided with the origin of the swing motion due to the driving force of the second driving shaft 15 at 0 degree. The center of the seat 2 traces an orbit L 21 like a figure of infinity mark or a figure of siding eight, as shown in FIG. 14. FIG. 15 shows the waveforms of the swing motion due to the first driving gear 14 and the second driving gear 15 in the example shown in FIG. 14.

Figure 16:
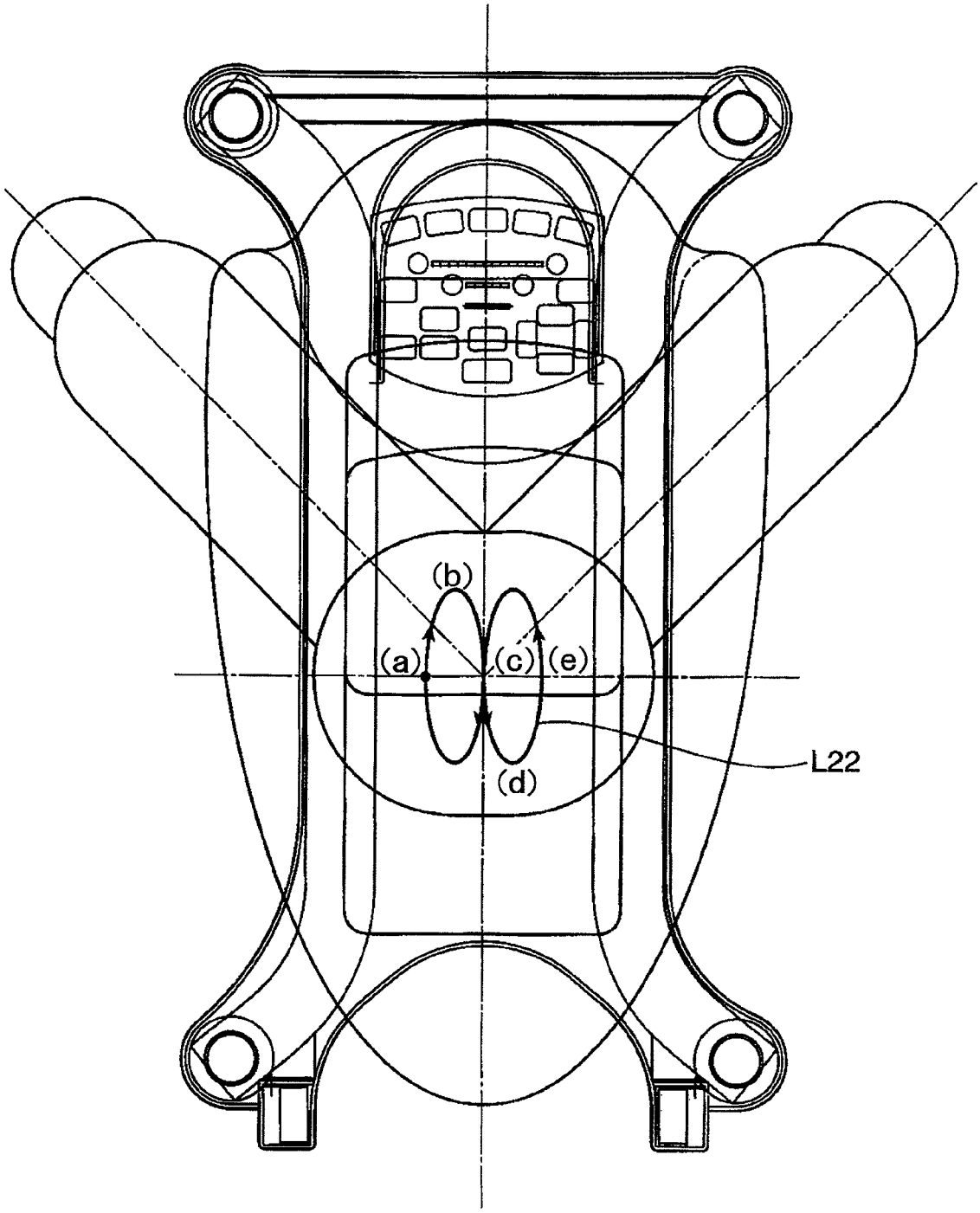
FIG. 16 is a plain view showing a trace of the swing motion of the center of the seat when the gear ratio of the first driving gear to the second driving gear is 1:2 and when timing of the origin of the swing motion in the anteroposterior direction is discrepant 180 degrees from the origin of the swing motion in the widthwise direction.
Figure 17:
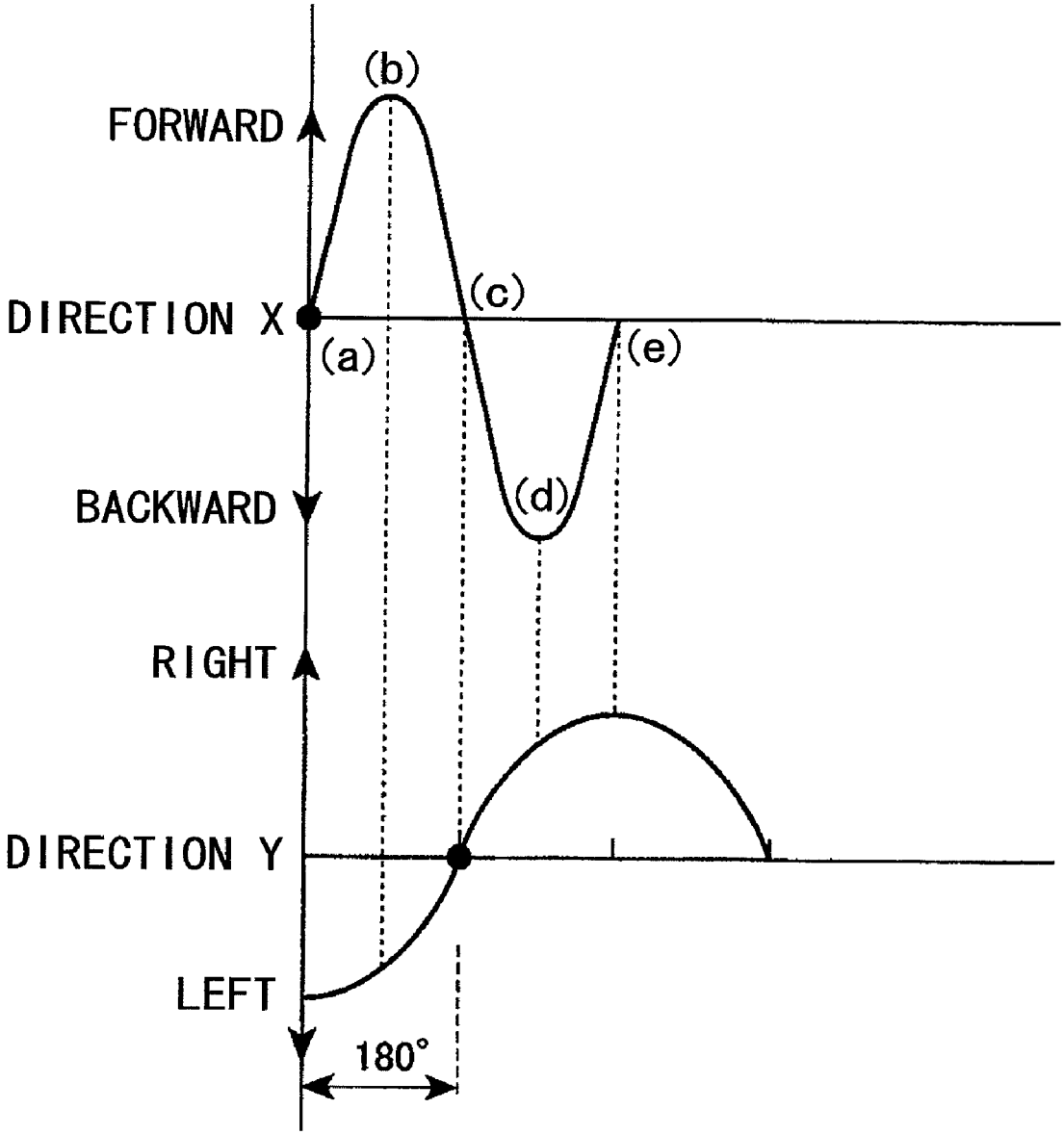
FIG. 17 is a graph showing a relation between a phase of the swing motion in the anteroposterior direction and a phase of the swing motion in the widthwise direction in the case shown in FIG. 16.

When it is assumed that the timing of the origin of the swing motion due to the driving force of the first driving shaft 14 is discrepant 180 degrees from the origin of the swing motion due to the driving force of the second driving shaft 15, the center of the seat 2 traces an orbit L 22 like a figure of an infinity mark or a figure of siding eight, as shown in FIG. 16. FIG. 17 shows the waveforms of the swing motion due to the first driving gear 14 and the second driving gear 15 in the example shown in FIG. 16. In comparison with FIG. 14 and FIG. 16, the directions of the orbits L21 and L22 that the center of the seat 2 traces are opposite to each other.

Figure 18:
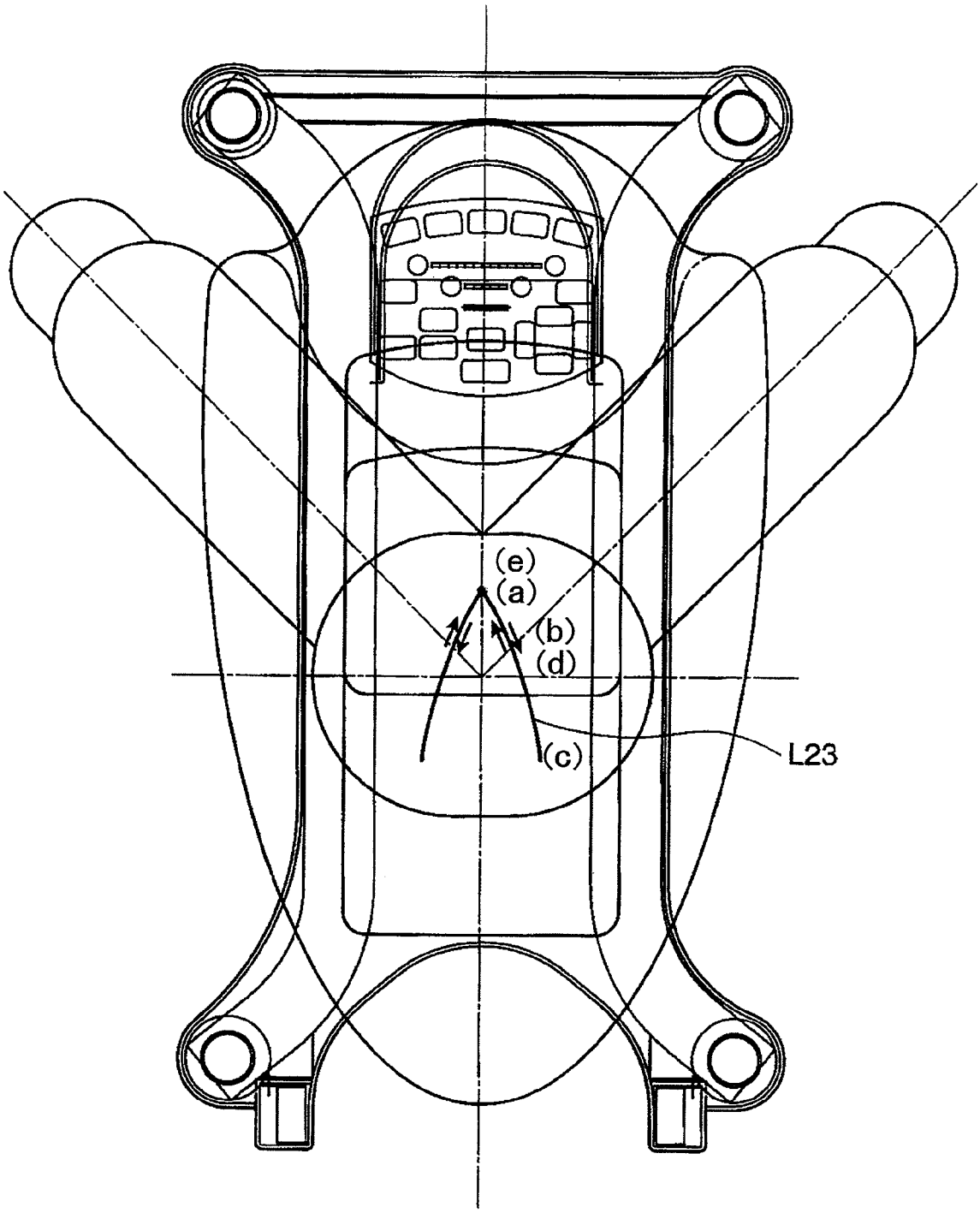
FIG. 18 is a plain view showing a trace of the swing motion of the center of the seat when the gear ratio of the first driving gear to the second driving gear is 1:2 and when timing of the origin of the swing motion in the anteroposterior direction is discrepant 90 degrees from the origin of the swing motion in the widthwise direction.
Figure 19:
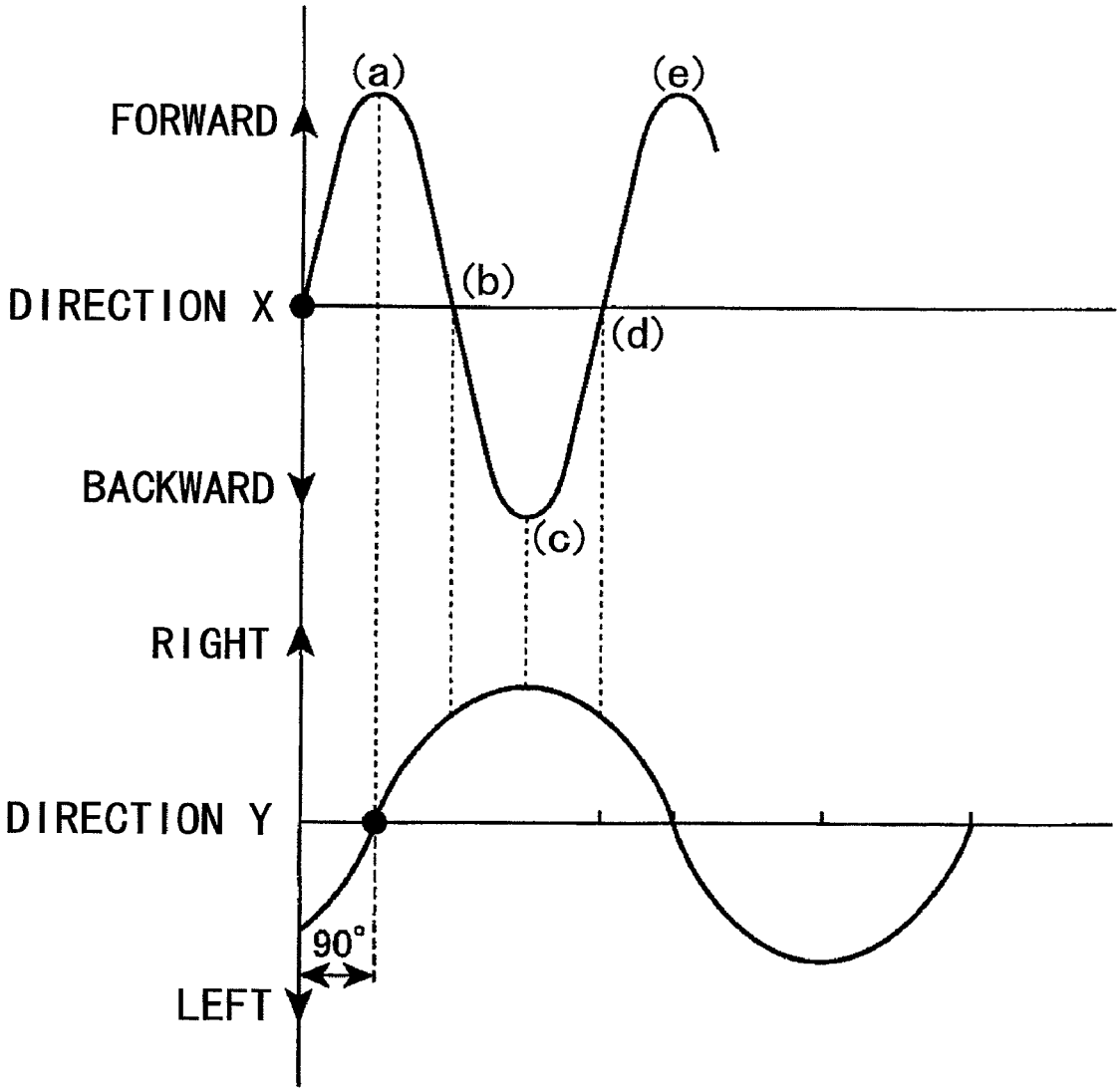
FIG. 19 is a graph showing a relation between a phase of the swing motion in the anteroposterior direction and a phase of the swing motion in the widthwise direction in the case shown in FIG. 18.

When it is assumed that phase of the swing motion due to the driving force of the second driving shaft 15 is delayed 90 degrees from the swing motion due to the driving force of the first driving shaft 14, the trace L23 of the center of the seat 2 becomes substantially a reverse V-shape, as shown in FIG. 18. FIG. 19 shows the waveforms of the swing motion due to the first driving gear 14 and the second driving gear 15 in the example shown in FIG. 18.

Figure 20:
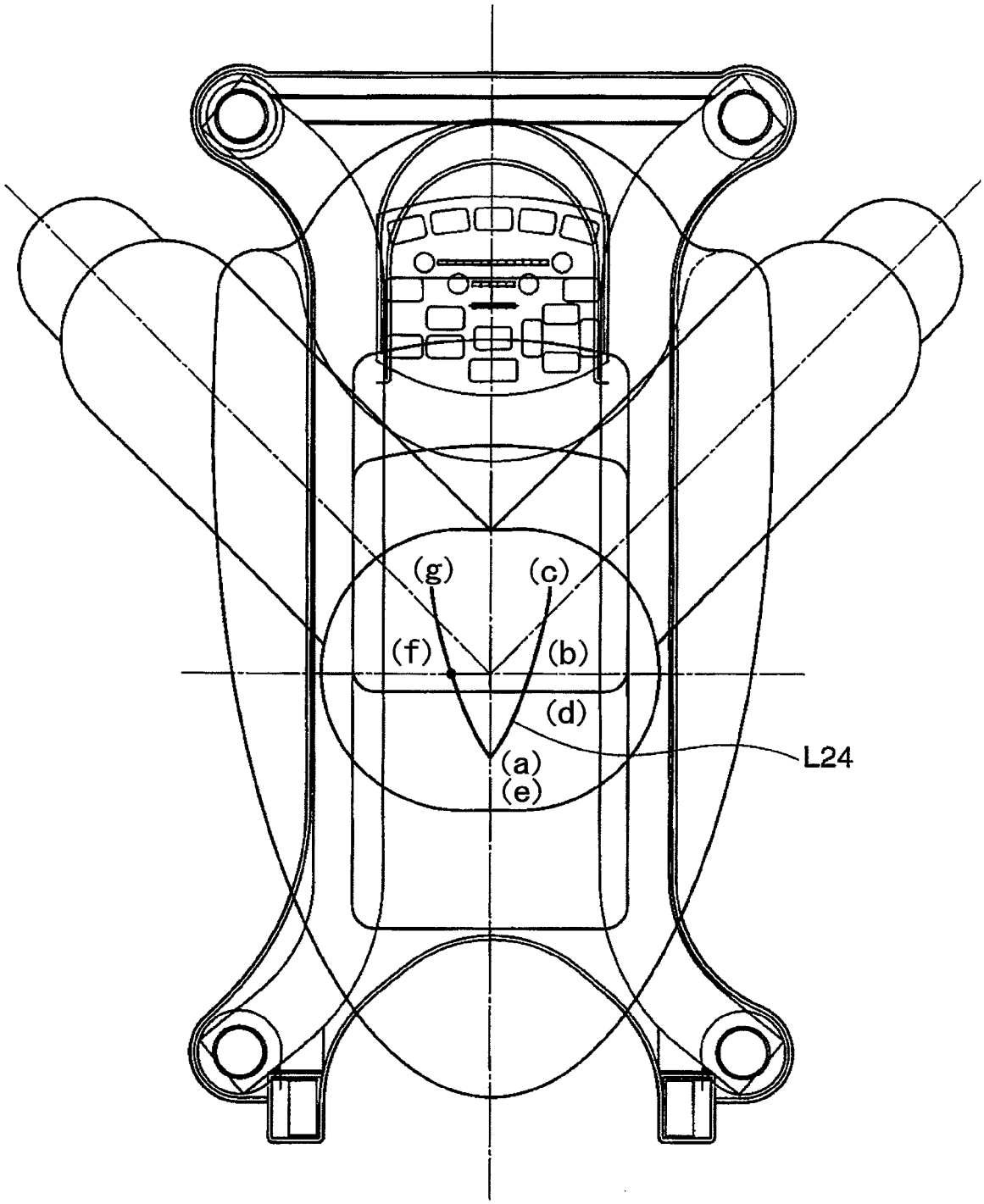
FIG. 20 is a plain view showing a trace of the swing motion of the center of the seat when the gear ratio of the first driving gear to the second driving gear is 1:2 and when timing of the origin of the swing motion in the anteroposterior direction is discrepant 270 degrees from the origin of the swing motion in the widthwise direction.
Figure 21:
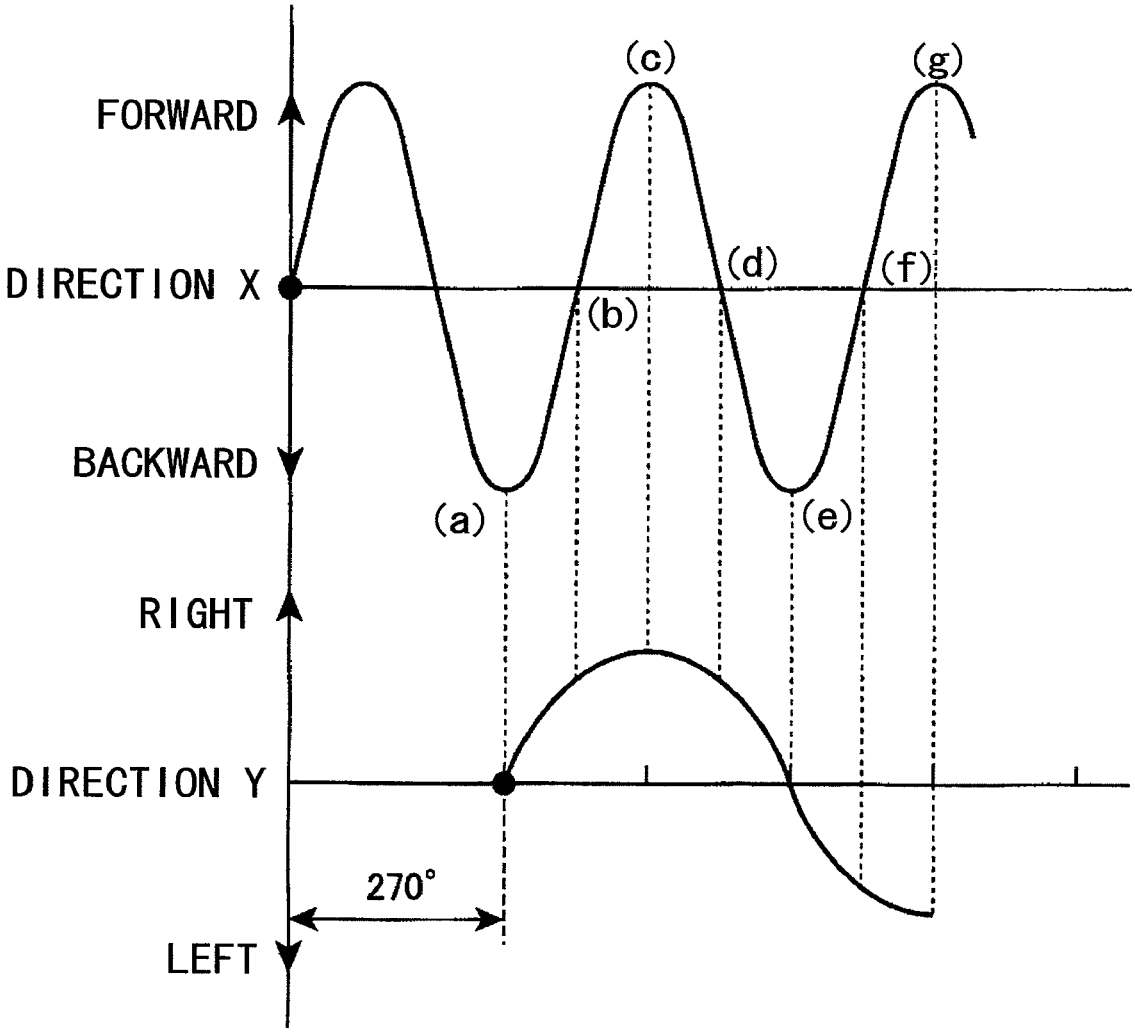
FIG. 21 is a graph showing a relation between a phase of the swing motion in the anteroposterior direction and a phase of the swing motion in the widthwise direction in the case shown in FIG. 20.

When it is assumed that phase of the swing motion due to the driving force of the second driving shaft 15 is advanced 90 degrees to, that is delayed 270 degrees from the swing motion due to the driving force of the first driving shaft 14, the trace L24 of the center of the seat 2 becomes substantially a V-shape, as shown in FIG. 20. FIG. 21 shows the waveforms of the swing motion due to the first driving gear 14 and the second driving gear 15 in the example shown in FIG. 20.

Figure 22:
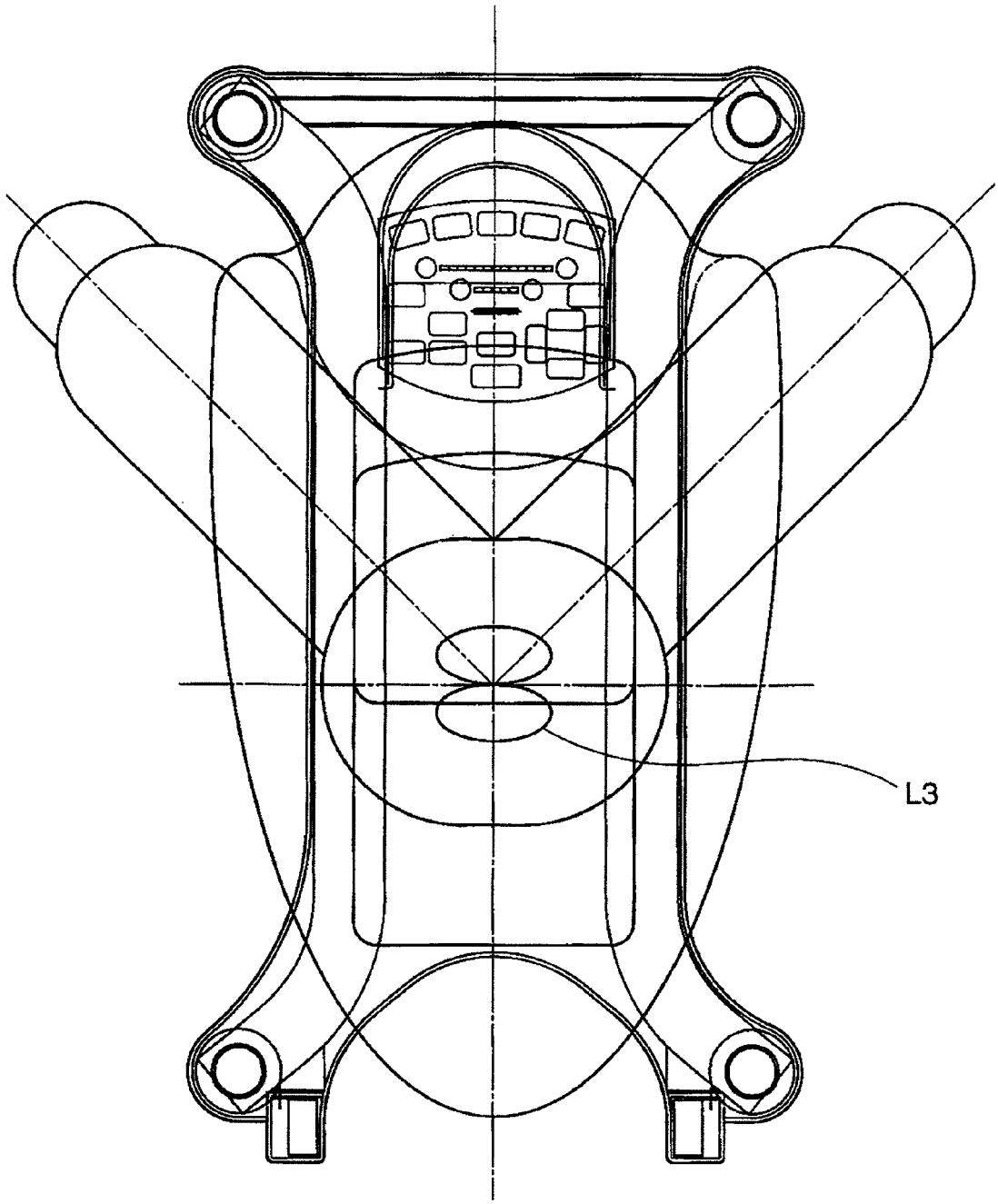
FIG. 22 is a plain view showing a trace of the swing motion of the center of the seat when the gear ratio of the first driving gear to the second driving gear is 2:1 and when timing of the origin of the swing motion in the anteroposterior direction is coincided with the origin of the swing motion in the widthwise direction at 0 degree.

In addition, when it is assumed that the gear ratio of the gear 14*b* of the first driving gear 14 to the gear 15*a* of the second driving gear 15 is set to be 2:1, the ratio of the first driving gear 14 to the rotation speed of the second driving gear 15 becomes 1:2. Furthermore, it is assumed that the timing of the origin of the swing motion due to the driving force of the first driving shaft 14 is coincided with the origin of the swing motion due to the driving force of the second driving shaft 15 at 0 degree. The center of the seat 2 traces an orbit L3 like a figure of eight, as shown in FIG. 22.

In this regard, it is noted that the eccentric shaft 22*a* which is the basic point of the swing motion of the eccentric rod 21 is assumed to be placed at a position to generate no offset to angular position of the swing mechanism 3 around the rotation axis T0. If the offset of the angular position of the swing mechanism 3 is generated, the traces L1, L21, L22, L23, and L3 appear at positions shifted in the offset direction, details of which will be described later. Furthermore, it is noted that the rotation axis T0 is assumed to be horizontal. The traces of the center of the seat 2 when the rotation axis T0 is slanted will be described later.

Figure 23:
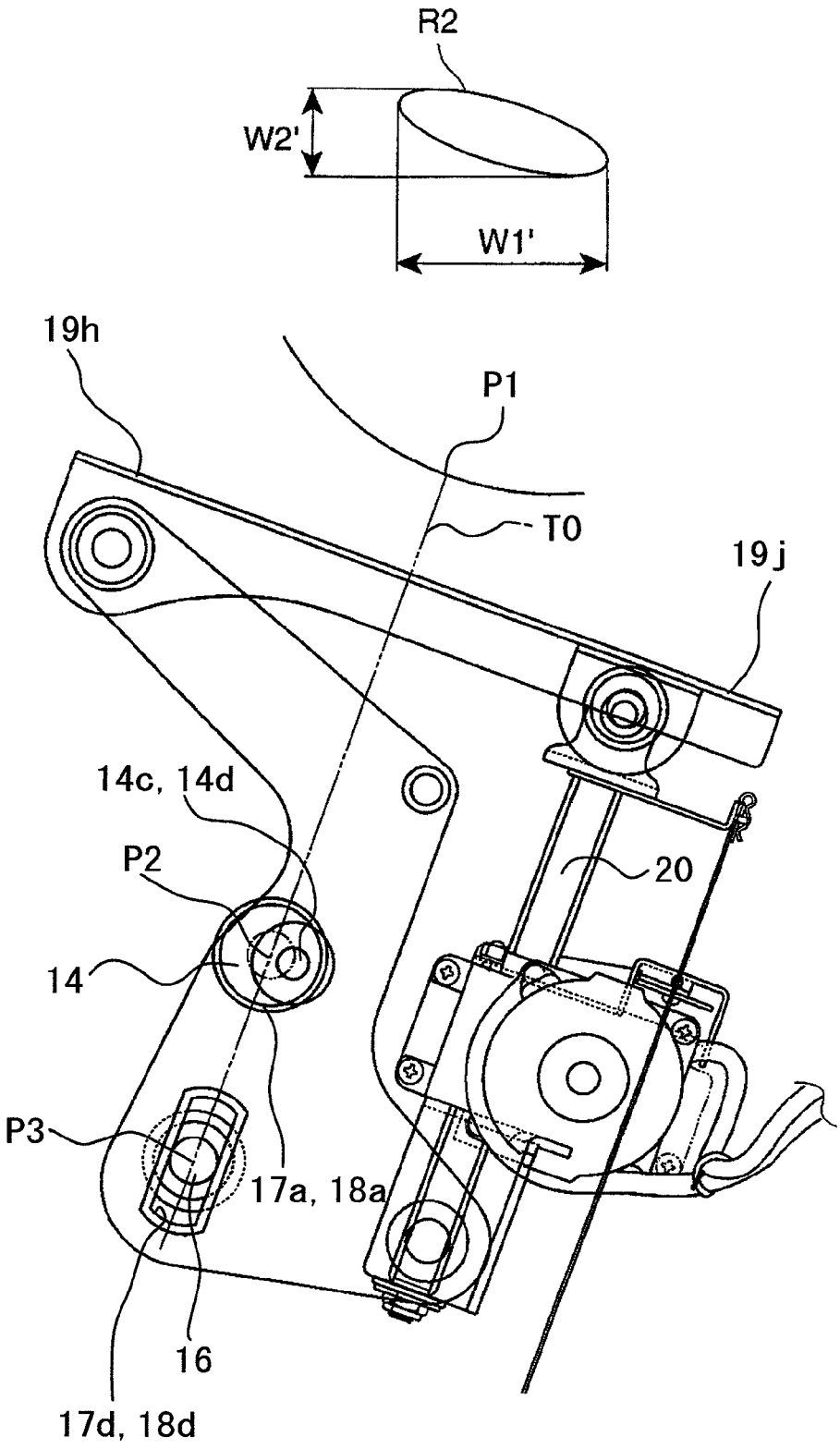
FIG. 23 is a side view showing a relation between the center of the seat and the centers of the eccentric shaft and the guide shaft when a first inclination mechanism for inclining the swing mechanism is extended, and a trace of a swing motion of the center of the seat.
Figure 24:
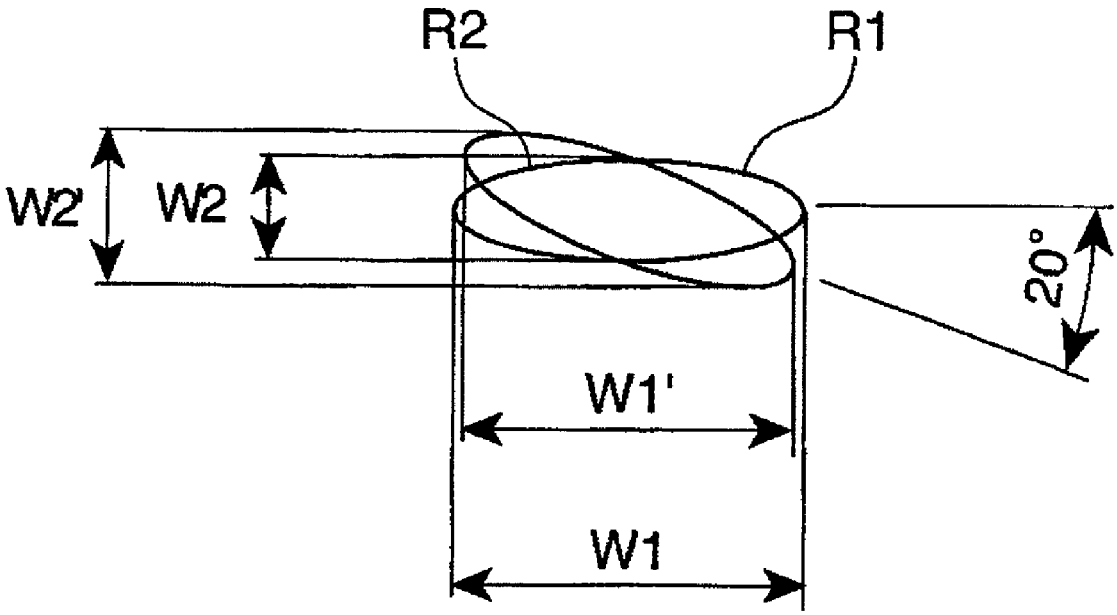
FIG. 24 is chart showing the traces of the center of the seat in cases shown in FIG. 9 and FIG. 23 for the sake of comparison.

The traces of the center of the seat 2 described above are considered when the guide grooves 17*d* and 18*d* of the hoisting levers 17 and 18 are oriented in the vertical direction. Then, when it is assumed that only the first inclination mechanism 12 is extended without extracting or contracting the second inclination mechanism 20, the seat 2 is anteverted with respect to the supporting unit 11, and thus, the trace of the center P1 of the seat 2 owing to the functions of the eccentric shafts 14*c* and 14*d* of the first driving shaft 14, the hoisting levers 17 and 18 and the guide shaft 16 becomes an anteverted elliptic orbit R2 watched from the side, as shown in FIG. 23. In this case, a component of the swing motion in the anteroposterior direction and a component of the swing motion in the vertical direction are switched back and force. When the seat 2 is inclined more than a predetermined angle, the stroke of the displacement of the center of the seat 2 in the vertical direction is increased from W2 to W2', although the stroke of the displacement of the center of the seat 2 in the horizontal direction is decreased from W1 to W1' as shown in FIG. 24, in comparison with the trace R1 shown in FIG. 9. Thereby, the size or shape of the trace of the center of the seat 2 can be varied.

Alternatively, it is possible to vary the inclination angle of the seat 2 by extending or contracting the second inclination mechanism 20. When the second inclination mechanism 20 is extended, as shown in FIG. 25, the distance H1 between the center of the seat 2 which is the center of the swing motion of the seat base 19 and the center of the guide shaft 16 which is the basic point of the swing motion due to the swing mechanism 3 is extended to a distance H1'. In case that the guide grooves 17*d* and 18*d* are oriented in the vertical direction, the stroke W2 of the motion of the seat 2 in the vertical direction is constant with no relation to the extension or contraction of the second inclination mechanism 20. In contrast, the stroke W1 of the motion of the seat 2 in the horizontal direction or the anteroposterior direction is varied, that is, expanded to a stroke W1'. With respect to the stroke of the motion of the seat 2 in the widthwise direction, a distance between the rotation axis T0 which is the basic point of the swing motion and the center of the seat 2 which is the center of the swing motion of the seat base 19 is varied, so that the stroke in the widthwise direction is varied.

According to the extension or contraction of the first inclination mechanism 12 and/or the second inclination mechanism 20, the stroke of the swing motion of the seat 2 can be varied. Furthermore, the longer the second inclination mechanism 20 is extended, the farther the front end of the seat 2 departs from the rotation axis T0, and thereby, the stroke of the swing motion (roll and yaw) of the seat 2 around the rotation axis T0 can be enlarged. Although an aged or feeble trainee uses the conventional balance exercise machine with reducing the moving speed of the swing motion, the balance exercise machine 1 in accordance with the present invention can respond to the aged or feeble trainee with varying the stroke of the swing motion, and thereby, the user can use the balance exercise machine 1 at ease. Alternatively, the balance exercise machine 1 in accordance with the present invention can respond to a trainee of builder-upper to expand the stroke of the swing motion. In this way, the balance exercise machine 1 in accordance with the present invention can provide the exercise suitable for a trainee corresponding to physical size, physical condition, age, sex, physical strength, and so on, so that it is possible to provide a balance exercise machine superior to the efficiency of the exercise.

In addition, when the first inclination mechanism 12 and the second inclination mechanism 20 are repeatedly extended and contracted in conjunction with each other, the seat 2 can be moved up and down with varying the trace and/or stroke of the swing motion thereof, so that it is possible to increase the variation of the balance exercise and to enhance the sense of realities of the balance exercise, and thereby, the motion menu which keeps interest of the trainee can be realized.

Figure 26:
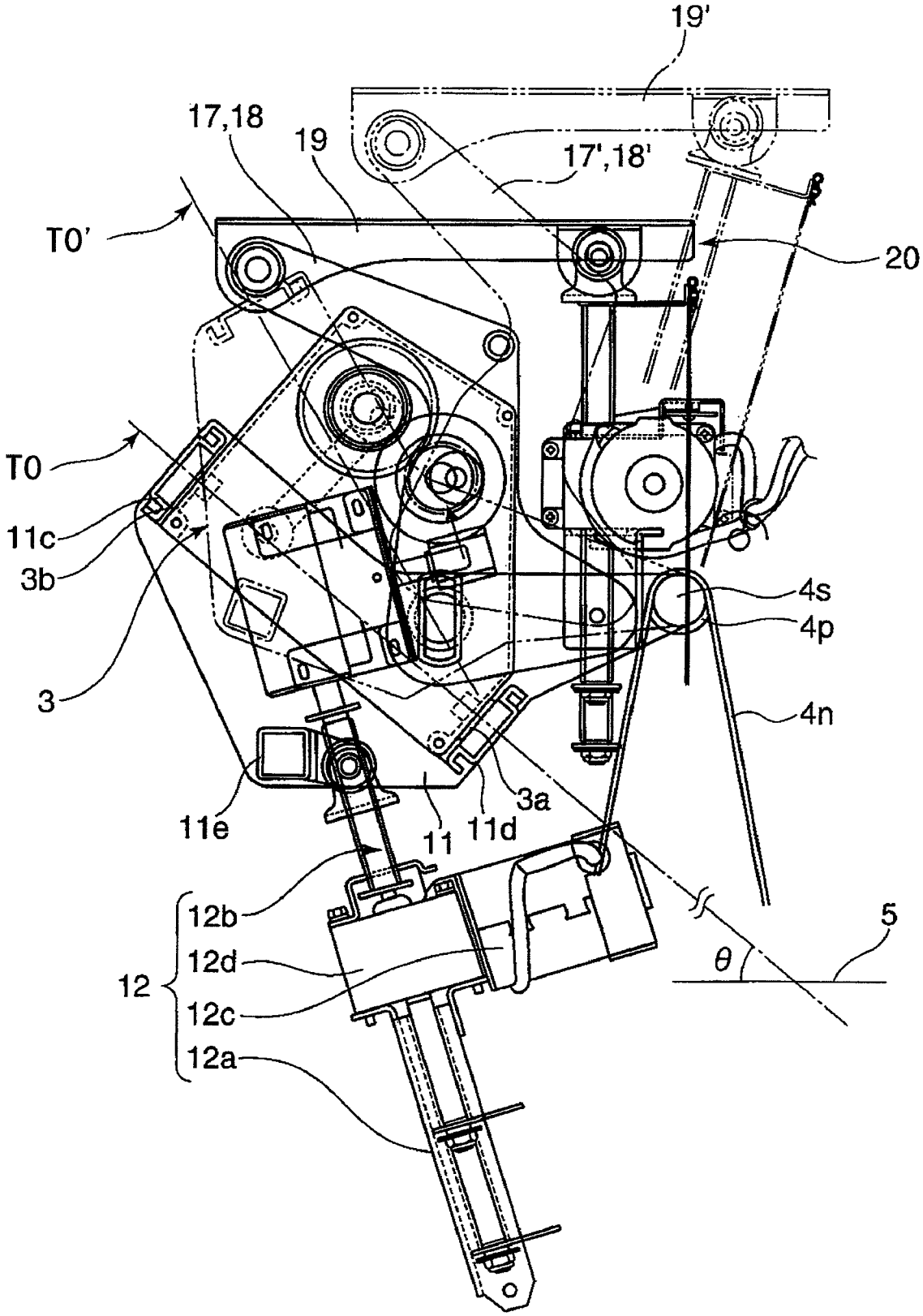
FIG. 26 is a side view showing displacement of each portion of the driving mechanism when the swing mechanism is inclined without inclining the seat by extending the first and second inclination mechanisms.

Furthermore, by repeatedly extending and contracting the first inclination mechanism 12 and the second inclination mechanism 20 in conjunction with each other, it is possible to vary the inclination angle of the rotation axis T0 in a plane including the anteroposterior direction (direction X) and the vertical direction (direction Z) without varying the angle of the seat 2 or the seat base 19, as shown in FIG. 26. In FIG. 26, solid lines illustrate a basic state of the supporting unit 11, the swing mechanism 3, the hoisting levers 17 and 18 and the seat base 19, where the rotation axis T0 has the inclination angle θ=45 degrees to the floor 5, and two dotted chain lines illustrate a displaced state of them which are designated by reference marks with dashes, where the rotation axis T0 stands up substantially vertically. From the basic state, when the first inclination mechanism 12 is contracted, the rotation axis T0 is tilted toward the horizontal line. Alternatively, when the first inclination mechanism 12 is extended from the basic state, the rotation axis T0 is tilted toward the vertical line.

When the rotation axis T0 approaches to the vertical direction (direction Z) from the anteroposterior direction (direction X), in other words, when the inclination angle θ becomes larger, the swing motion of the seat 2 due to the second driving gear 15 and the eccentric rod 21 is varied between the swing motion (rolling) in the widthwise direction (direction Y) and the swing motion around a vertical axis (when the center of the seat 2 is positioned on the rotation axis T0, it becomes yawing). Thus, the component of the reciprocating motion of the swing mechanism 3 in the anteroposterior direction can be converted to the component in the vertical direction. Consequently, the balance exercise machine 1 can vary the patterns of the swing motion wider and can vary the stroke of the swing motion following to the variation of the pattern of the swing motion, so that the pattern of the swing motion suitable to the region of the human body of the trainee to be exercised can be obtained. The balance exercise machine 1 excels in the usability with keeping the interest to the user.

Hereupon, the variations of the angle of the swing motion following to the variations of the inclination angle θ are exemplified in a table 1. The angle of the swing motion is varied due to a quantity of the eccentricity of the eccentric shaft 15*b* of the second driving gear 15, a length of the eccentric rod 21, a distance between the rotation axis T0 to the center of the driving shaft 22, and so on.

TABLE 1

| θ | Angle of Rolling | Angle of Yawing |
|---|---|---|
| 0° | 9.6° | 0° |
| 30° | 8.3° | 4.8° |
| 45° | 6.8° | 6.8° |
| 60° | 4.8° | 8.3° |
| 90° | 0° | 9.6° |

Figure 27:
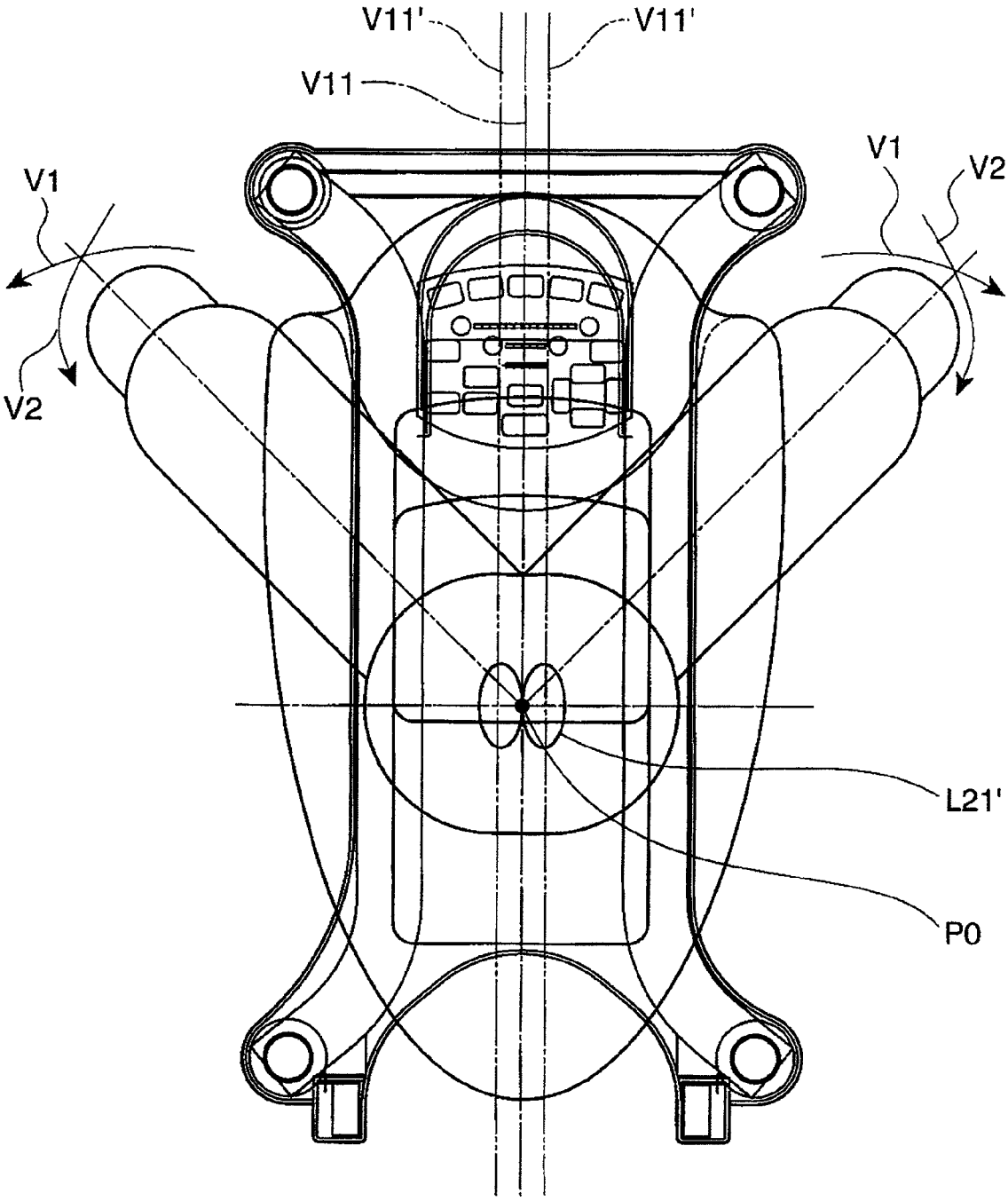
FIG. 27 is a plan view showing a variation of the trace of the center of the seat corresponding to the inclination of the swing mechanism in comparison with FIG. 14.

The closer the rotation axis T0 approaches to the vertical direction (θ=90°) from the horizontal direction (θ=0°), the swing motion of the seat 2 is varied from the rolling in the widthwise direction to the yawing around the vertical axis. When the gear ratio of the gear 14*b* of the first driving gear 14 to the gear 15*a* of the second driving gear 15 is set to be 1:2, for example, the trace L21 of the center of the seat 2 like the figure of infinity mark or the figure of siding eight becomes smaller as designated by a reference mark L21' in FIG. 27. However, twisting motions designated by reference marks V1 and V2 are added to the motion of the seat 2, as alternated. Such twisting motion varies corresponding to the difference between the phase of the eccentric shafts 14*c* and 14*d* of the first driving shaft 14 and the phase of the eccentric shaft 15*b* of the second driving shaft 15. Hereupon, it is assumed that the phase 0° of the eccentric shafts 14*c* and 14*d* of the first driving shaft 14 is coincided with the phase 0° of the eccentric shaft 15*b* of the second driving shaft 15 at the basic point P0 where the displacement of the center of the seat 2 is 0. The larger the seat 2 rolls in the widthwise direction, the larger the seat 2 will be twisted toward the direction to roll as designated by the reference mark V1. Alternatively, the closer the center of the seat 2 returns to the basic point P0, the smaller the quantity of the twisting motion of the seat 2 becomes as designated by the reference mark V2. Thus, the effect of the exercise by the balance exercise machine 1 can be enhanced.

In contrast, it is assumed that the phase 180° of the eccentric shafts 14*c* and 14*d* of the first driving shaft 14 is coincided with the phase 0° of the eccentric shaft 15*b* of the second driving shaft 15 under the condition that the gear ratio of the gear 14*b* of the first driving gear 14 to the gear 15*a* of the second driving gear 15 is set to be 1:2. The trace of the center of the seat 2 takes a trace L22 like the figure of infinity mark or the figure of siding eight as shown in FIG. 16. The larger the seat 2 rolls in the widthwise direction, the larger the seat 2 will be twisted toward the direction opposite to roll as designated by the reference mark V2. Alternatively, the closer the center of the seat 2 returns to the basic point P0, the smaller the quantity of the twisting motion of the seat 2 becomes as designated by the reference mark V1. In this case, it is possible to perform the exercise softly.

In case of the V-shaped trace L24 of the center of the seat 2 shown in FIG. 20, the larger the seat 2 rolls in the widthwise direction, the larger the seat 2 will be twisted toward the direction to roll as designated by the reference mark V1.

Furthermore, the height of the seat 2 from the floor 5 can be varied by slanting the first inclination mechanism 12 and the second inclination mechanism 20 in conjunction with each other so as to cancel the inclination of the seat 2 due to the extension or contraction of them. Thus, it is possible to adjust the height of the seat 2 corresponding to the tall of the trainee or to enable the trainee to get on and off the seat 2 easy without providing any additional mechanism to lift up or down the seat 2.

For example, when increasing the effect of the exercise at a local region of the human body of the trainee by the exercise with inclining the seat 2, the variation of the inclination angle of the seat 2 due to the extension or contraction of the first inclination mechanism 12 is not necessarily canceled by the extension or contraction of the second inclination mechanism 20. The seat 2 may be swung in a condition to be slanted a predetermined angle.

When the seat 2 is mounted on the seat base 19 in a state to be turned about 90 degrees, the swing motion of the seat 2 by the swing mechanism 3 becomes the combination of the reciprocal swing motion in the widthwise direction and the reciprocal up and down motion in the vertical direction. The trace of the center of the seat 2 becomes an elliptic orbit watched from the front or the sear face of the balance exercise machine 1. The wing motion of the seat 2 due to the second driving gear 15 and the eccentric rod 21 becomes the pitching motion in the widthwise direction. Alternatively, the seat 2 may be mounted on the seat base 19 back to front. In this way, the direction of the seat 2 to the swing mechanism 3 may be selected arbitrarily corresponding to the purpose of the exercise.

On the other hand, although the gear 23 is rotated by the driving force of the motor 24, when the eccentric shaft 22*a* of the driving shaft 22 which is integrally connected to the gear 23 is moved to the lowest position thereof, that is, the basic point of the swing motion of the eccentric rod 21 is positioned at the lower dead point, and when the eccentric shaft 22*a* is moved to the highest position thereof, that is, the basic point of the swing motion of the eccentric rod 21 is positioned at the upper dead point, the swing mechanism 3 generates the largest offset around the rotation axis T0.

Figure 28:
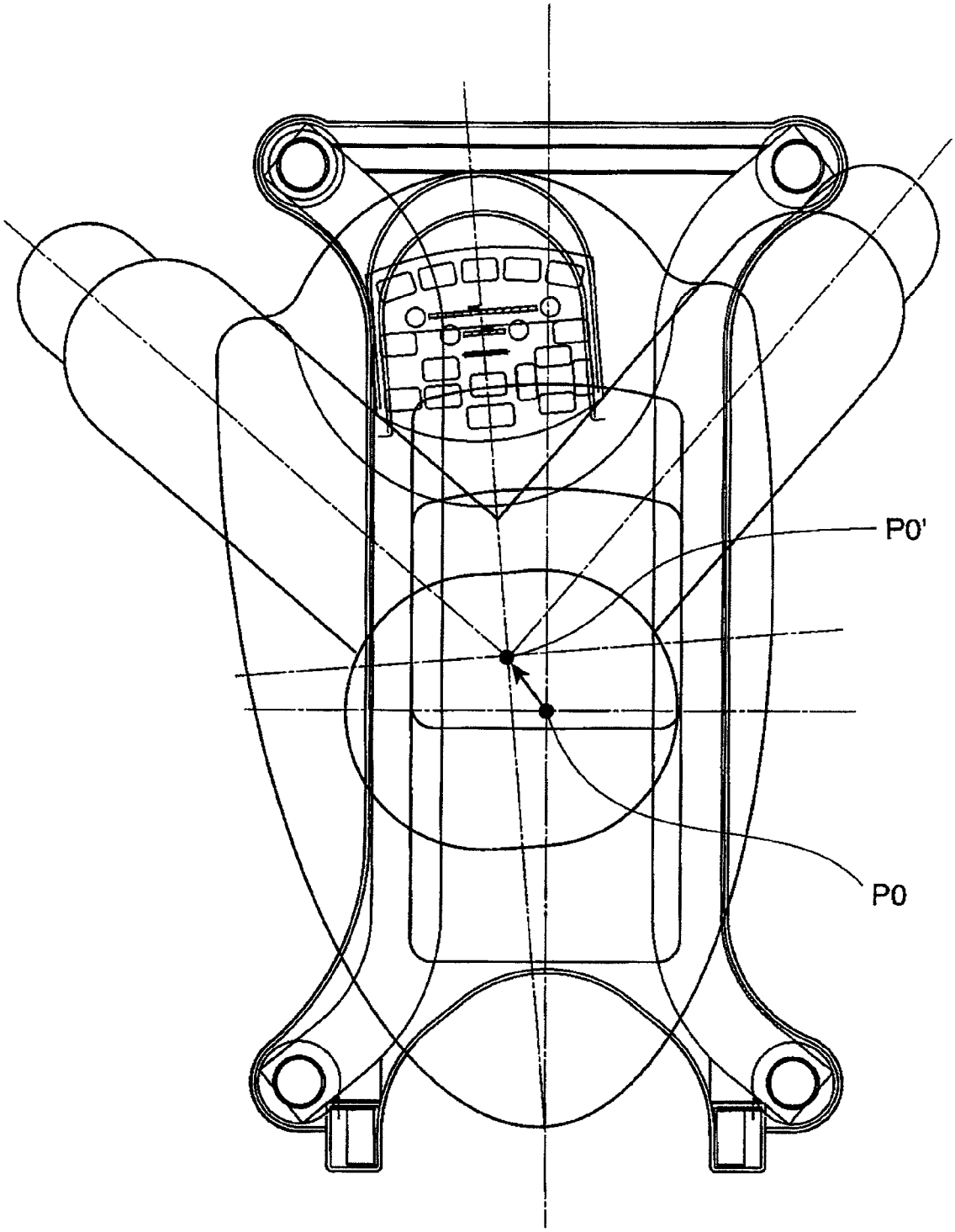
FIG. 28 is a plan view showing a shift of a basic point of the swing motion of the center of the seat due to offset of the swing mechanism leftward.
Figure 29:
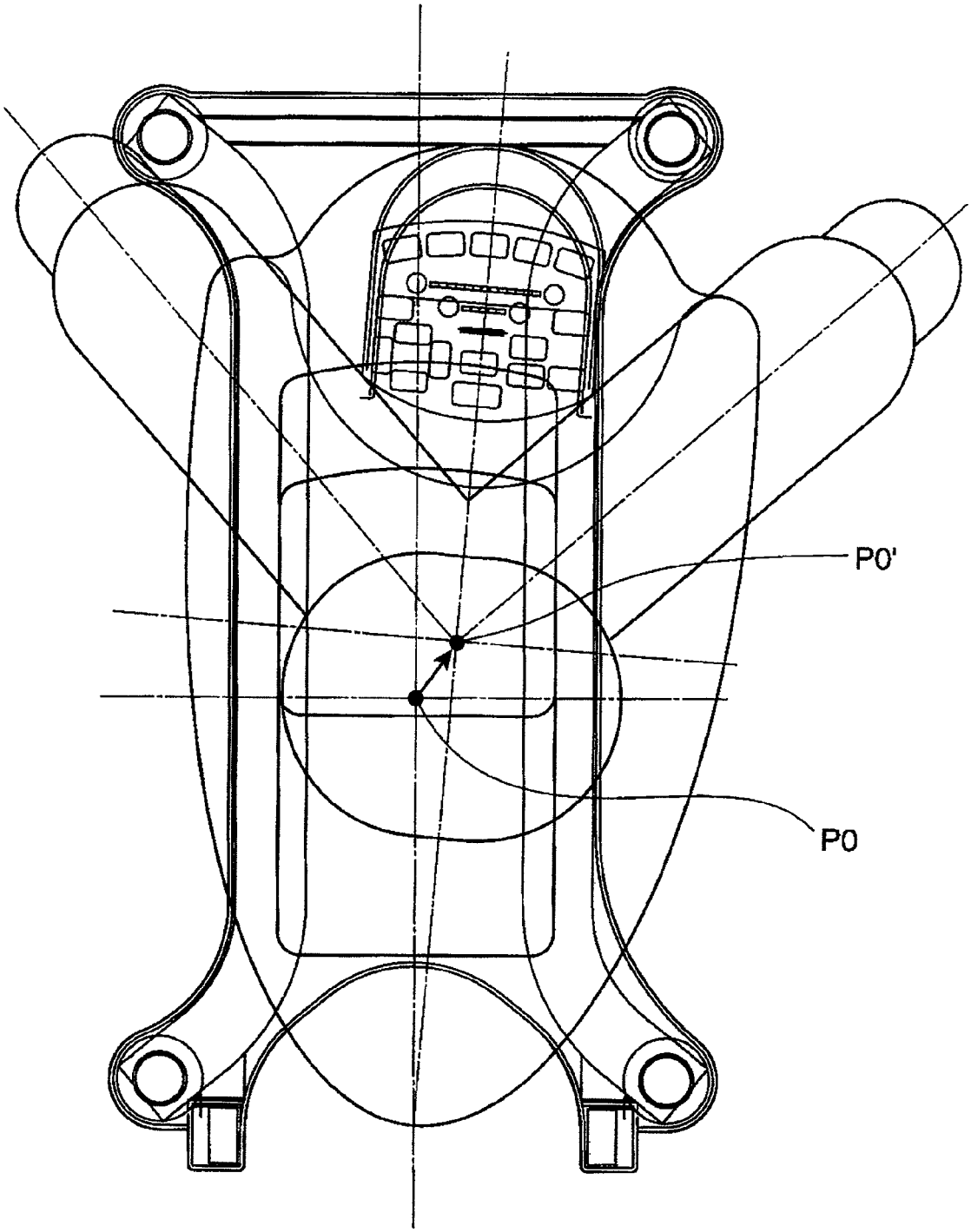
FIG. 29 is a plan view showing a shift of a basic point of the swing motion of the center of the seat due to offset of the swing mechanism rightward.

When the inclination angel θ of the rotation axis T0 is substantially equal to 0 degree (θ≈0°) and the swing motion of the seat 2 has a component of the twisting motion (yaw), the basic point of the swing motion of the seat 2 is shifted to the point P0 to P0', as shown in FIG. 28 or 29. FIG. 28 shows a case that the eccentric shaft 22*a* pulls down the eccentric rod 21, and the swing mechanism 3 is offset leftward. FIG. 29 shows a case that the eccentric shaft 22*a* pushes up the eccentric rod 21, and the swing mechanism 3 is offset rightward. In addition, when the inclination angel θ of the rotation axis T0 is equal to 0 degree (θ=0°) and the swing motion of the seat 2 has no component of the twisting motion (yaw), the center axis V11 of the swing motion in the anteroposterior direction is shifted leftward or rightward as designated by reference marks V11' in FIG. 27.

Accordingly, the trace of the center of the seat 2 can be inclined around the rotation axis T0, so that the rolling angle, the yawing angle and the displacement in the anteroposterior direction in the right side of the rotation axis can be differed from those in the left side. Thus, lateral muscle or adductor muscle of the human body of the trainee can be strengthened partially, so that physical fitness can be enhances efficiently, and sense of balance of the trainee can be trained.

When the motor 24 is continuously driven, the inclination of the swing mechanism 3 around the rotation axis T0 is continuously varied, so that the patterns of the exercise can be diversified, and thereby, the balance exercise machine excellent in the usability with keeping the interest to the user can be realized.

As mentioned above, it is assumed that the phase 0° of the eccentric shafts 14*c* and 14*d* of the first driving shaft 14 is coincided with the phase 0° of the eccentric shaft 15*b* of the second driving shaft 15. Furthermore, the phase 0° of the eccentric shafts 14*c* and 14*d* of the first driving shaft 14 is selected to be the lower dead point. Still furthermore, the pitch of the worm 13*b* is selected so that the worm 13*b* can be rotated by the force applied from the seat base 19 that is the load to the motor 13.

According to such a configuration, even though the power supply to the motor 13 is stopped when the phase of the eccentric shafts 14*c* and 14*d* of the first driving shaft 14 takes an optional angle other than the above mentioned 0°, the first driving gear 14 that generates the swing motion of the seat 2 in the anteroposterior direction and in the vertical direction can be rotated due to the weight of the seat 2 and the trainee, and thereby, the motor 13 and the second driving gear that generates the swing motion in the widthwise direction are also rotated. The phase of the first driving gear 14 and the phase of the second driving gear 15 are selected so that when the eccentric shafts 14*c* and 14*d* of the first driving gear 14 reaches to the lower dead point, that is, the center of the seat 2 is positioned at the lowest position, the center of the seat 2 also positioned at the center in the anteroposterior direction and in the widthwise direction. Thus, the seat 2 naturally goes down and stops at the lowest position (in direction Z) at the center of the motion in the anteroposterior direction (direction X) and in the widthwise direction (direction Y) by switching off the power.

Consequently, the balance exercise machine 1 can be stopped at the initial position without using any sensor and complex control, so that the getting on and off of the trainee becomes easier, the trainee can be sit on the seat 2 in good posture, and thereby, the balanced exercise can be provide to the trainee.

Furthermore, a tooth form of worm 13*b* can be cut in both direction of the clockwise direction and the counterclockwise direction corresponding to the rotation direction of the motor 13, the first driving gear 14 and the second driving gear 15. In this embodiment, the tooth form of the worm 13*b* is cut in the direction so that the force is applied to the worm 13*b* from the worm wheel 14*a* in a direction to press fit the worm 13*b* to the output shaft 13*a* of the motor 13. Thus, it is possible to prevent the falling off the worm 13*b* from the output shaft 13*a* of the motor 13, and thereby, the sudden falling of the seat while the seat has gone down due to the eight of the trainee.

Figure 30:
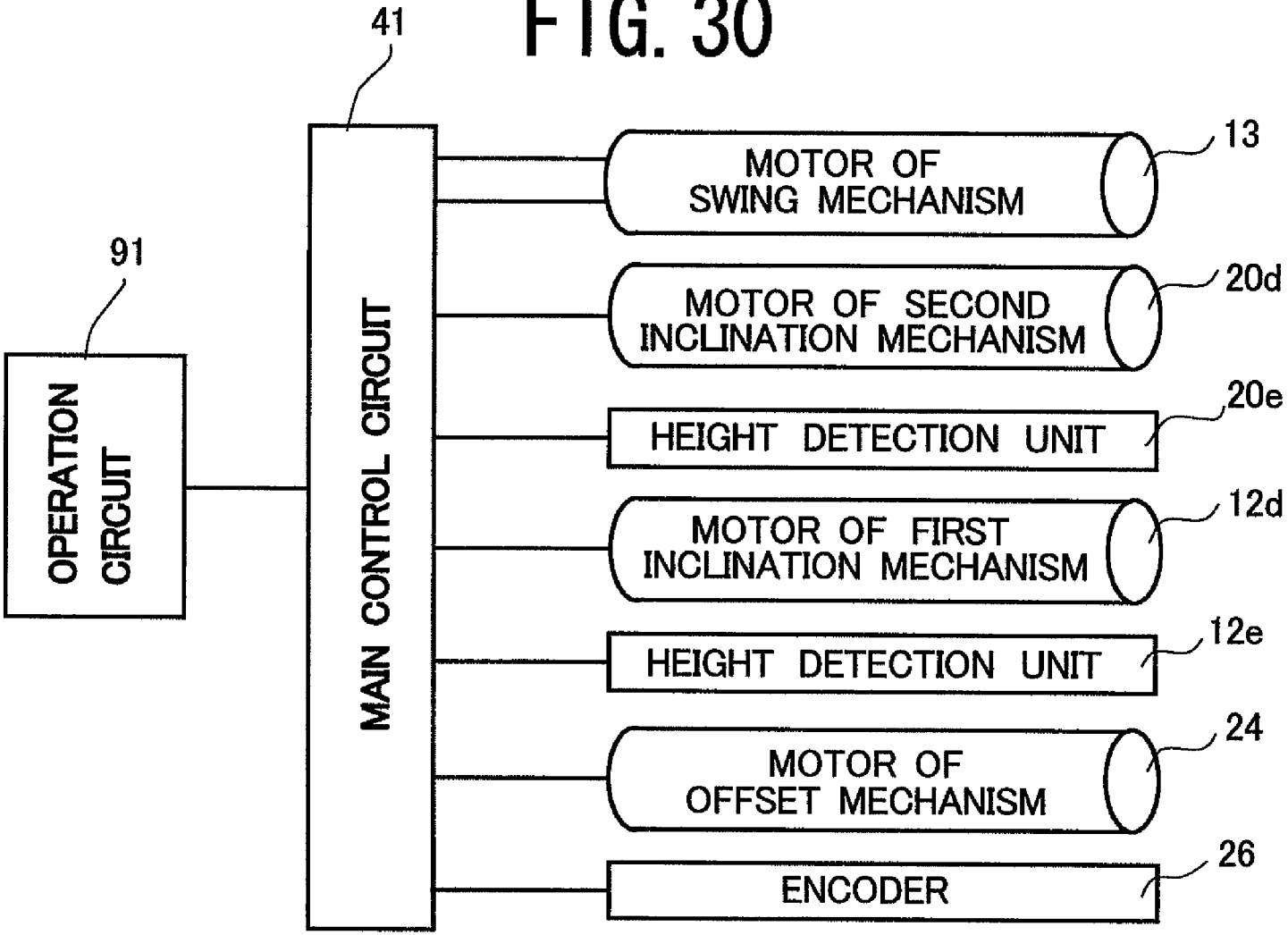
FIG. 30 is a block diagram showing an electrical configuration of the balance exercise machine.

FIG. 30 shows an electrical block configuration of the balance exercise machine 1. A main control circuit 4*l* on the main circuit board 4*r* controls to drive the motor 13 such as a DC blushless motor for swinging the seat 2, a motor 12*d* such as a DC motor for extending or contracting the first inclination mechanism 12 thereby inclining the swing mechanism 3 in the anteroposterior direction, a motor 20*d* such as a DC motor for extending or contracting the second inclination mechanism 20 thereby inclining the seat 2 to the swing mechanism 3, and a motor 24 such as a DC motor for inclining the swing mechanism 3 in the widthwise direction, corresponding to signals from an operation circuit 91 on the operation circuit board 9*a*. A quantity of inclination of the seat base 19 (or the seat 2) to a reference point of the swing mechanism 3 by the motor 20*d* is detected by the height detection unit 20*e*. A quantity of inclination of the supporting unit 11 to the column 4*b*, that is, the inclination angle θ of the rotation axis T0 by the motor 12*d* is detected by the height detection unit 12*e*. A quantity of inclination of the swing mechanism 3 to the supporting unit 11 by the motor 24 is detected by the encoder 26. The outputs of the height detection units 12*e* and 20*e* and the encoder 26 are inputted to the main controller 4*l*.

Figure 31:
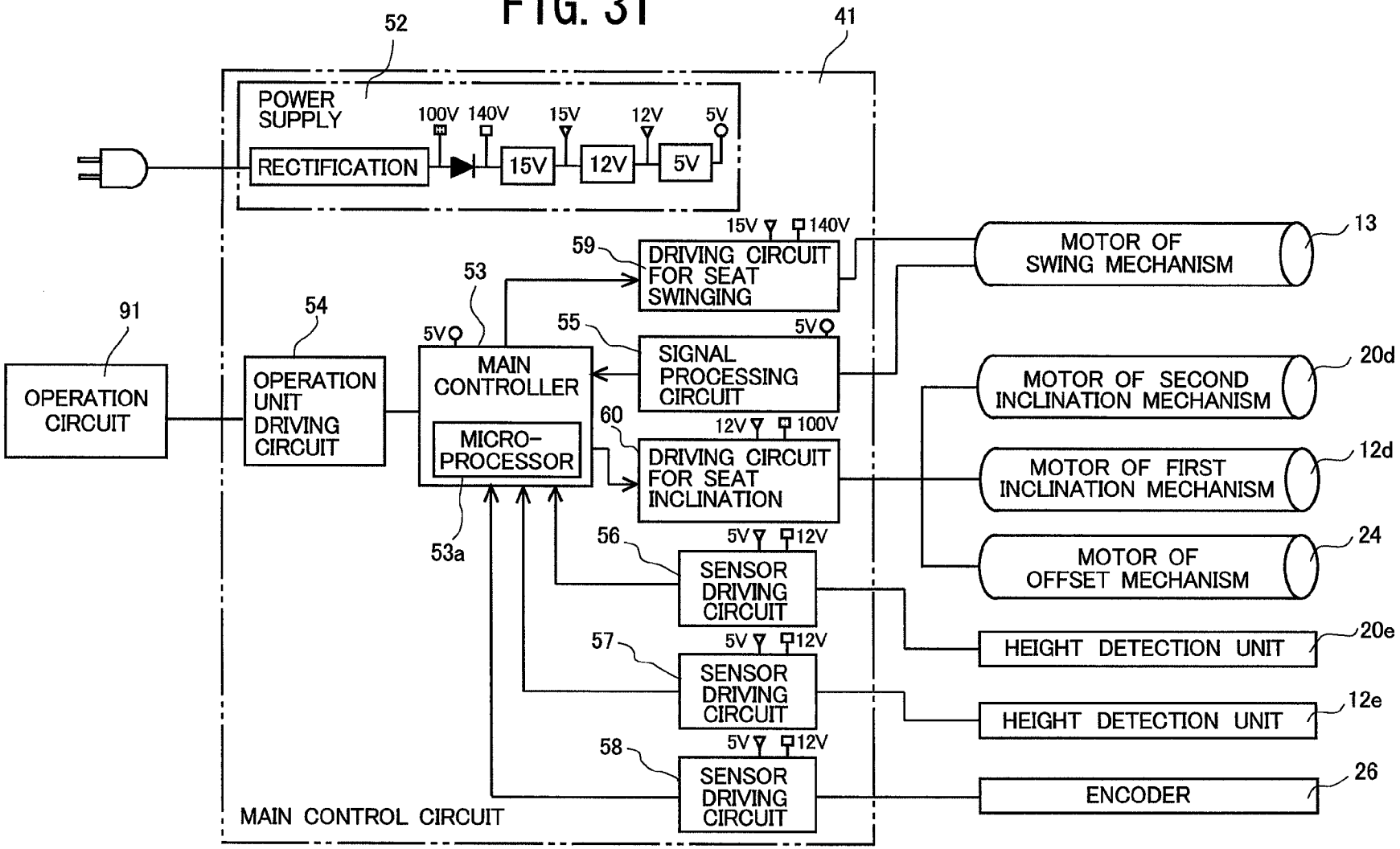
FIG. 31 is a block diagram showing an electrical configuration of a main control circuit of the balance exercise machine.

FIG. 31 shows an electrical block configuration of the main control circuit 4*l*. A commercial AC power inputted through a plug 51 is converted to DC powers of 140V, 100V, 15V, 12V and 5V, for example, by the power supply circuit 52. Converted each DC power is supplied to each circuit in the main control circuit 4*l*. In the main control circuit 4*l*, a main controller 53 comprising a microprocessor 53*a* controls the operation of the balance exercise machine 1, entirely. For example, the main controller 53 displays a message or the like on a monitor display device such as an LCD (Liquid Crystal Display) of the operation unit 9 and receives signals corresponding to, for example, operation by the user from the operation circuit 91 through an operation unit driving circuit 54. The main controller 53 drives the motor 13 for swing motion through a driving circuit 59 and drives the motors 12*d*, 20*d* and 24 for inclination through a driving circuit 60 corresponding to the signals corresponding to the operation by the user, an angular position and a speed of the rotation of the motor inputted through a sensor signal processing circuit 55, and results of detection of the height detection units 12*e* and 20*e* and the encoder 26 inputted through the sensor driving circuits 56, 57 and 58.

Figure 32:
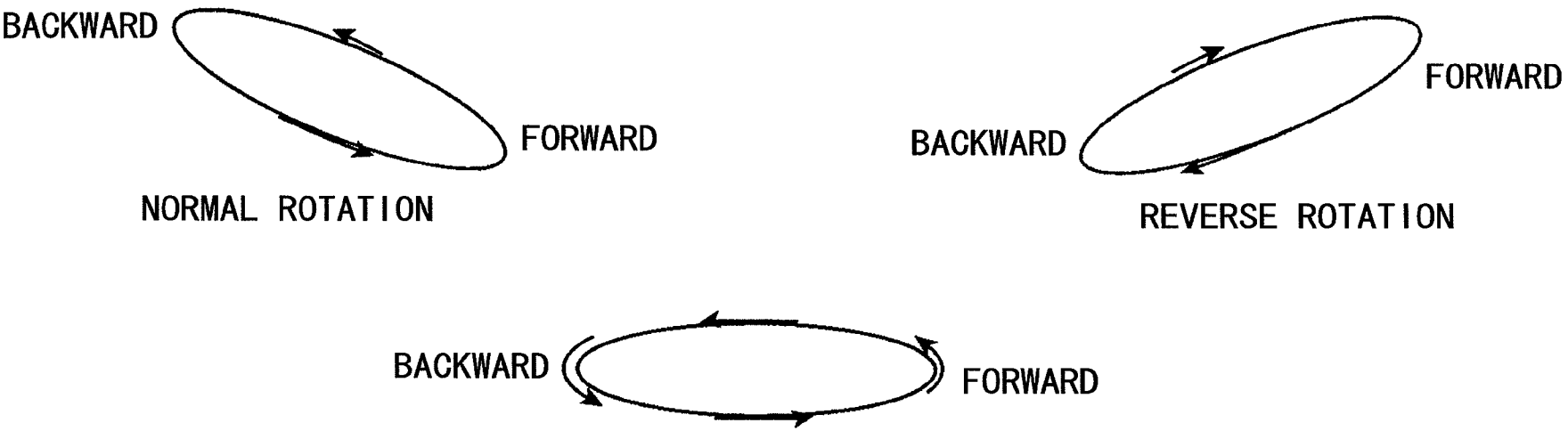
FIG. 32 is a chart for explaining variation of control of a motor for swinging the seat by a main controller of the balance exercise machine.

It is noted that the main controller 53 can switch the rotation direction of the motor 13 for generating the swing motion of the seat 2 when the inclination angle θ of the rotation axis T0 is varied by driving the motor 12*d*, as shown in FIG. 32. In addition, the main controller 53 can vary the rotation speed of the motor 13 slower while the seat 2 is lifted up relative to the rotation speed while the seat 2 is lifted up in a continuous swing motion.

By switching the rotation direction of the motor 13, it is possible to move the seat 2 along a reversed trace, so that the trainee can experience a different exercise from the exercise when the motor 13 is rotated in a normal direction, without riding on the seat reversely. Consequently, a muscle in a region of the human body of the trainee which is not generally used can be built up.

In addition, by varying the rotation speed of the motor 13 slower while the seat 2 is lifted up and faster while the seat 2 is lift down, the largest torque required to the motor 13 can be reduced, so that, a compact motor can be used as the motor 13 for generating the swing motion of the seat 2, thereby enabling to downsize the swing mechanism 3. Furthermore, by varying the rotation speed of the motor 13 slower while the seat 2 is lifted up and faster while the seat 2 is lift down, it is possible to increase the burden due to the weight to the foot on the stirrup 7 even though the stroke of the swing motion of the seat 2 in the vertical direction is the same.

The balance exercise machine in accordance with the present invention is not limited to the above mentioned embodiment. It is sufficient that the balance exercise machine in accordance with the present invention comprises: a seat on which a trainee sits; a swing mechanism that swings the seat; an extendable and contractible mechanism that varies a distance between the seat and the swing mechanism by extension or contraction thereof so as to vary a stroke of a swing motion of the seat; and a controller that controls the swing mechanism and the extendable and contractible mechanism.

According to such a configuration, when the extendable and contractible mechanism is driven, a distance between the swing mechanism and the seat can be expanded or contracted. For example, when the extendable and contractible mechanism is extended, the stroke of the swing motion of the seat can be expanded, so that the balance exercise machine which enables to increase the patterns of the motion and to widen the stroke of the motion of the seat can be realized. Furthermore, when the extendable and contractible mechanism is driven in conjunction with the swing mechanism, the patterns of the motion of the seat can be increased much more.

In the balance exercise machine mentioned above, it is preferable further to comprise: a supporting unit that supports the swing mechanism rotatably around a predetermined rotation axis; a pedestal that is to be established on a floor and supports the supporting unit rotatably around a first horizontal axis. The extendable and contractible mechanism is comprised of: a first inclination mechanism that is provided between the pedestal and the supporting unit, and varies an inclination angle of the rotation axis of the swing mechanism in a vertical plane; and a second inclination mechanism that is provided between the swing mechanism and the seat, and varies an inclination angle of the seat.

According to such a configuration, the swing mechanism can be swung around the rotation axis due to the driving force of its own. Thus, the seat can be swung in a widthwise direction of the balance exercise machine. Furthermore, since the supporting unit is rotatable around the first horizontal axis and the first inclination mechanism is provided between the pedestal and the supporting unit, an angle of the rotation axis of the swing mechanism to the horizontal line can be varied, in other words, the rotation axis of the swing mechanism can be stood up or down. Still furthermore, since the second inclination mechanism is provided between the swing mechanism and the seat, it is possible to vary the posture of the seat independently from the motion of the first inclination mechanism.

In the above mentioned configuration, it is preferable that the controller controls to drive the first inclination mechanism and the second inclination mechanism in conjunction with each other to compensate at least a part of inclination of the seat due to extension or contraction of the first inclination mechanism by extension or contraction of the second inclination mechanism.

According to such a configuration, for example, when the second inclination mechanism is driven in conjunction with the first inclination mechanism, the seat can be lifted up or down with keeping the posture thereof.

In the above mentioned configuration, it is preferable that the controller controls to drive the first inclination mechanism to vary the inclination angle of the rotation axis of the swing mechanism in a range from substantially horizontal to substantially vertical.

Alternatively, it is preferable that the controller controls to drive the first inclination mechanism and the second inclination mechanism in conjunction with each other to vary the inclination angle of the rotation axis of the swing mechanism so as to vary the swing motion of the seat between a swing motion around a horizontal axis to a swing motion around a vertical axis with compensating at least a part of inclination of the seat due to extension or contraction of the first inclination mechanism by extension or contraction of the second inclination mechanism.

In the above mentioned configuration, it is preferable that the swing mechanism is comprised of a motor, a first driving gear and a second driving gear which are respectively driven by a driving force of the motor; the first driving gear has an eccentric shaft which generates a displacement in a first vertical plane including an anteroposterior direction of the balance exercise machine and a vertical direction, and thereby, the seat is swung in the first vertical plane; and the second driving gear has an eccentric shaft which generates a displacement in a second vertical plane including a widthwise direction of the balance exercise machine and the vertical direction, and thereby, the seat is swung in the second vertical plane.

According to such a configuration, it is possible to generate both of the swing motions of the seat in the widthwise direction and the anteroposterior direction by the driving force of the single motor. Thus, the swing mechanism can be simplified and downsized, and consequently, the balance exercise machine using the same can be downsized, and the cost of the balance exercise machine can be reduced.

Furthermore, it is preferable that the swing mechanism has a mechanism to convert the displacement in the first vertical plane to a movement of the seat to trace an elliptic orbit.

According to such a configuration, when the swing mechanism is driven in conjunction with the motion of the first inclination mechanism and/or the motion of the second inclination mechanism, the shape of the elliptic orbit can be varied optionally.

Still furthermore, it is preferable that the controller varies a rotation speed of the motor slower while the seat is lifted up relative to the rotation speed while the seat is lifted up in a continuous swing motion.

According to such a configuration, a compact motor having a smaller power can be used as the motor of the driving mechanism, so that the power consumption and the cost of the balance exercise machine can be reduced.

Still furthermore, it is preferable that the balance exercise machine further comprises an offset mechanism that offsets the swing mechanism around the rotation axis. Thus, it is possible to provide an offset to the angular position of the swing mechanism relative to the supporting unit around the rotation axis, so that the swing mechanism, that is, the seat can be swung around the rotation axis with respect to a basic point which is slanted with a predetermined angle around the rotation axis.

This application is based on Japanese patent applications 2006-146596 and 2006-146642 which are filed May 26, 2006 in Japan, the contents of which are hereby incorporated by references.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A balance exercise machine comprising:

a seat on which a trainee sits;

a swing mechanism that swings the seat;

an extendable and contractible mechanism that varies a distance between the seat and the swing mechanism by extension or contraction thereof so as to vary a stroke of a swing motion of the seat;

a controller that controls the swing mechanism via the user and the extendable and contractible mechanism;

a supporting unit that supports the swing mechanism rotatably around a predetermined rotation axis; and a pedestal that is to be established on a floor and supports the supporting unit rotatably around a first horizontal axis, wherein the extendable and contractible mechanism is comprised of a first inclination mechanism that is connected between the pedestal and the supporting unit, and varies an inclination angle of the rotation axis of the swing mechanism in a vertical plane, and a second inclination mechanism that varies an inclination angle of the seat;

the first inclination mechanism is attached at a front portion of the pedestal and the second inclination mechanism is attached at a rear portion of the pedestal in an anteroposterior direction of the balance exercise machine;

the swing mechanism is comprised of a motor, a first driving gear and a second driving gear which are respectively driven by a driving force of the motor;

the first driving gear has an eccentric shaft which generates a displacement in a first vertical plane including an anteroposterior direction of the balance exercise machine and a vertical direction, and thereby, the seat is swung in the first vertical plane; and the second driving gear has an eccentric shaft which generates a displacement in a second vertical plane including a widthwise direction of the balance exercise machine and the vertical direction, and thereby, the seat is swung in the second vertical plane.

2. The balance exercise machine in accordance with claim 1, wherein the controller controls to drive the first inclination mechanism and the second inclination mechanism in conjunction with each other to compensate at least a part of inclination of the seat due to extension or contraction of the first inclination mechanism by extension or contraction of the second inclination mechanism.

3. The balance exercise machine in accordance with claim 1, wherein the controller controls to drive the first inclination mechanism to vary the inclination angle of the rotation axis of the swing mechanism in a range from substantially horizontal to substantially vertical.

4. The balance exercise machine in accordance with claim 1, wherein the controller controls to drive the first inclination mechanism and the second inclination mechanism in conjunction with each other to vary the inclination angle of the rotation axis of the swing mechanism so as to vary the swing motion of the seat between a swing motion around a horizontal axis to a swing motion around a vertical axis with compensating at least a part of inclination of the seat due to extension or contraction of the first inclination mechanism by extension or contraction of the second inclination mechanism.

5. The balance exercise machine in accordance with claim 1, wherein the swing mechanism converts the displacement in the first vertical plane to a movement of the seat to trace an elliptic orbit.

6. The balance exercise machine in accordance with claim 1, wherein the controller varies a rotation speed of the motor slower while the seat is lifted up relative to the rotation speed while the seat is lifted up in a continuous swing motion.

7. The balance exercise machine in accordance with claim 1 further comprising:

an offset mechanism that offsets the swing mechanism around the rotation axis.

8. A balance exercise machine comprising:

a seat on which a trainee sits;

a swing mechanism that swings the seat;

an extendable and contractible mechanism that varies a distance between the seat and the swing mechanism by extension or contraction thereof so as to vary a stroke of a swing motion of the seat; and a controller that controls the swing mechanism via the user and the extendable and contractible mechanism, wherein the swing mechanism is comprised of a motor, a first driving gear and a second driving gear which are respectively driven by a driving force of the motor;

the first driving gear has an eccentric shaft which generates a displacement in a first vertical plane including an anteroposterior direction of the balance exercise machine and a vertical direction, and thereby, the seat is swung in the first vertical plane;

the second driving gear has an eccentric shaft which generates a displacement in a second vertical plane including a widthwise direction of the balance exercise machine and the vertical direction, and thereby, the seat is swung in the second vertical plane;

the extendable and contractible mechanism is comprised of a first inclination mechanism that is connected between a pedestal and the supporting unit, and varies an inclination angle of the rotation axis of the swing mechanism in a vertical plane, and a second inclination mechanism that varies an inclination angle of the seat; and the first inclination mechanism is attached at a front portion of the pedestal and the second inclination mechanism is attached at a rear portion of the pedestal in the anteroposterior direction of the balance exercise machine.

9. The balance exercise machine in accordance with claim 8, wherein the swing mechanism has a mechanism to convert the displacement in the first vertical plane to a movement of the seat to trace an elliptic orbit.

10. The balance exercise machine in accordance with claim 8, wherein the controller varies a rotation speed of the motor slower while the seat is lifted up relative to the rotation speed while the seat is lifted up in a continuous swing motion.

11. A balance exercise machine comprising:

a seat on which a trainee sits;

a swing mechanism that swings the seat;

an extendable and contractible mechanism that varies a distance between the seat and the swing mechanism by extension or contraction thereof so as to vary a stroke of a swing motion of the seat;

a controller that controls the swing mechanism via the user and the extendable and contractible mechanism; and an offset mechanism that offsets the swing mechanism around the rotation axis, wherein the extendable and contractible mechanism is comprised of a first inclination mechanism that is attached at a front portion of a pedestal in an anteroposterior direction, and varies an inclination angle of the rotation axis of the swing mechanism in a vertical plane, and a second inclination mechanism that is attached at a rear portion of the pedestal in the anteroposterior direction, and varies an inclination angle of the seat; and the extendable and contractible mechanism is connected at a center in a widthwise direction of the balance exercise machine.

* * * * *